US007950871B2

(12) United States Patent
Lass et al.

(10) Patent No.: US 7,950,871 B2
(45) Date of Patent: May 31, 2011

(54) VEHICLE RESTRAINT SYSTEM

(75) Inventors: Horst Lass, Bochum (DE); Werner Heimann, Elversberg (DE); Walter Klein, Katzwinkel (DE); Barbara Von Linsingen-Heintzmann, Bochum (DE)

(73) Assignee: Heintzmann Sicherheitssysteme GmbH & Co. KG, Bochum (DE)

( * ) Notice: Subject to any disclaimer, the term of this patent is extended or adjusted under 35 U.S.C. 154(b) by 129 days.

(21) Appl. No.: 12/444,282

(22) PCT Filed: Oct. 8, 2007

(86) PCT No.: PCT/DE2007/001785

§ 371 (c)(1),
(2), (4) Date: Apr. 3, 2009

(87) PCT Pub. No.: WO2008/040343

PCT Pub. Date: Apr. 10, 2008

(65) Prior Publication Data

US 2010/0008721 A1 Jan. 14, 2010

(30) Foreign Application Priority Data

Oct. 6, 2006 (DE) ..... 10 2006 047 808

(51) Int. Cl.
*E01F 13/00* (2006.01)

(52) U.S. Cl. ..... 404/6

(58) Field of Classification Search ..... 404/6, 9; 256/1, 13.1

See application file for complete search history.

(56) References Cited

U.S. PATENT DOCUMENTS

| | | | | | |
|---|---|---|---|---|---|
| 3,308,724 | A * | 3/1967 | Smith | 404/7 |
| 3,428,299 | A * | 2/1969 | Mogensen | 256/13.1 |
| 3,678,815 | A * | 7/1972 | Younker | 14/73 |
| 4,138,095 | A * | 2/1979 | Humphrey | 256/64 |
| 4,190,380 | A * | 2/1980 | Almer et al. | 404/6 |
| 4,406,563 | A * | 9/1983 | Urlberger | 404/6 |
| 4,452,431 | A * | 6/1984 | Stephens et al. | 256/13.1 |
| 4,645,375 | A * | 2/1987 | Carney, III | 404/6 |
| 4,954,009 | A * | 9/1990 | Kellison | 404/6 |
| 5,181,695 | A * | 1/1993 | Arthur | 256/13.1 |
| 5,244,172 | A * | 9/1993 | Allega | 248/161 |
| 5,403,112 | A * | 4/1995 | Carney, III | 404/6 |
| 2005/0254891 | A1 * | 11/2005 | Ceccarelli | 404/6 |

FOREIGN PATENT DOCUMENTS

| | | |
|---|---|---|
| DE | 30 36 227 C2 | 10/1982 |
| DE | 37 30 368 A1 | 3/1989 |
| DE | 38 27 030 C2 | 4/1989 |

(Continued)

*Primary Examiner* — Raymond W Addie

(74) *Attorney, Agent, or Firm* — Henry M. Feiereisen; Ursula B. Day

(57) ABSTRACT

The invention relates to a vehicle restraint system provided for delimiting roadways and including guide barriers (1) which are placed next to one another in a detachable manner. Each guide barrier (1) includes a housing-type base body (2) that can be placed upright on the ground and a guide rail (14) arranged above the base body (2). The guide rail (14) and the base body (2) can be coupled together by means of tension rods (19), wherein each tension rod (29) is connected to the guide rail (14) with an upper end (20) and can be tightened at a bottom end (22) in an abutment (23) arranged in the base body (2). The guide rail (14) and the base body (2) are suitably arranged at a vertical distance from one another by spacers (30), with the tension rod (19) extending through the spacers (30).

50 Claims, 21 Drawing Sheets

FOREIGN PATENT DOCUMENTS

| | | | |
|---|---|---|---|
| DE | 38 20 930 | A1 | 2/1990 |
| DE | 89 15 625 | U1 | 11/1990 |
| DE | 298 18 624 | U1 | 1/1999 |
| DE | 103 18 357 | A1 | 1/2004 |
| EP | 1 418 274 | A | 5/2004 |
| FR | 2 613 739 | A1 | 10/1988 |

* cited by examiner

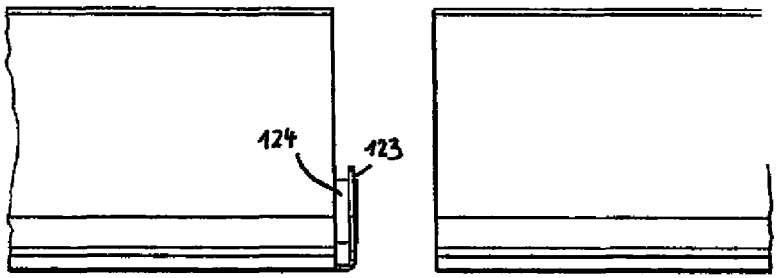
Fig. 26
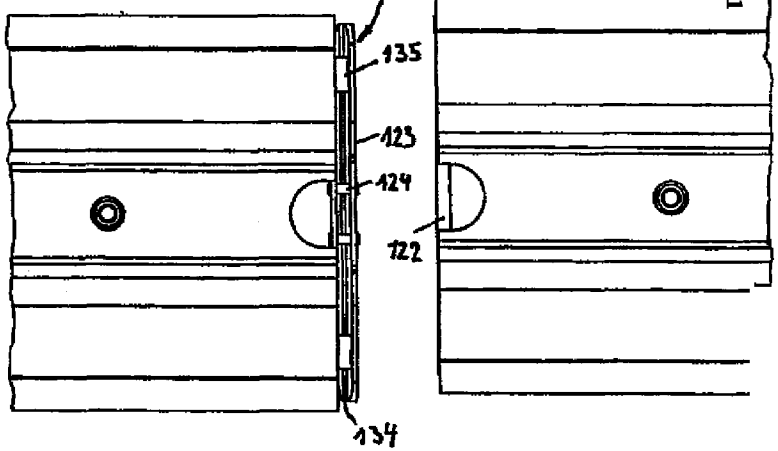
Fig. 27
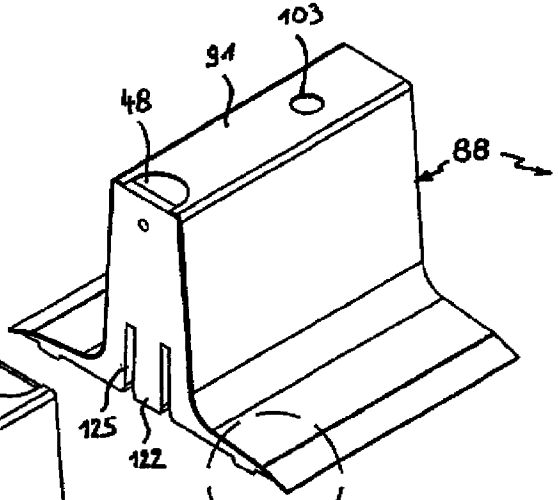
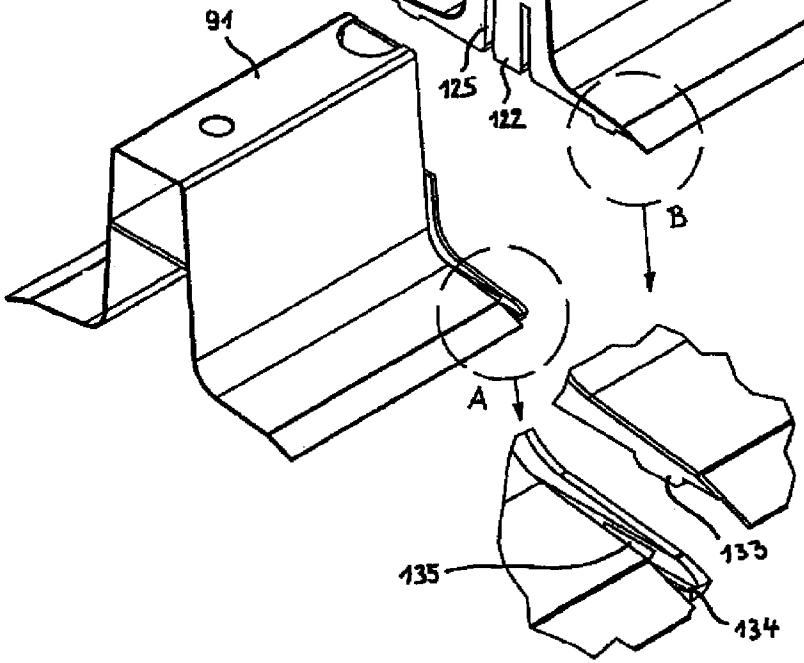
Fig. 24
Fig. 25

VEHICLE RESTRAINT SYSTEM

CROSS-REFERENCES TO RELATED APPLICATIONS

This application is the U.S. National Stage of International Application No. PCT/DE2007/001785, filed Oct. 8, 2007, which designated the United States and has been published as International Publication No. WO 2008/040343 and which claims the priority of German Patent Application, Serial No. 10 2006 047 808.8, filed Oct. 6, 2006, pursuant to 35 U.S.C. 119(a)-(d).

BACKGROUND OF THE INVENTION

The invention relates to a vehicle restraint system for delimiting roadways, which is constructed from guide barriers detachably placed side-by-side.

A vehicle restraint system is known in the art, for example, from DE 38 27 030 C2. The vehicle restraint system is formed of a string of guide barriers arranged side-by-side. Each guide barrier has a housing-type base body which can be placed on the ground and a guide rail arranged above the base body. In the conventional design, the guide rail and the base body are connected by posts having a Sigma-shape in horizontal cross-section. The guide rails are welded to the posts or formfittingly coupled to the posts via guide brackets. The lower ends of the posts are welded at the inside of the base body. Embodiments exist where the posts are screwed onto the base bodies by way of support plates and threaded bolts.

EP 1 418 274 A1 discloses a comparable vehicle restraint system with an improved coupling device for connecting two guide barriers. Another modification of the vehicle restraint system for use on bridges is disclosed in DE 103 18 357 A1.

The conventional vehicle restraint system has proven to be effective in practical use. It is used predominantly in construction areas representing a greater risk, where a stopping ability up to retention step H2 according to DIN EN 1317 is required.

DE 38 20 930 A1 describes a lane divider constructed of a number of base bodies which are implemented as solid bodies and made, for example, of recycled plastic The base bodies are arranged sequentially in their respective longitudinal direction and are formfittingly coupled to one another with a corresponding coupling device, thereby forming a contiguous wall. A row of cap elements can be placed on the row of the base bodies, so that the divider attains a greater overall height. The cap elements are arranged with an offset of half a length. The cap elements can be loosely placed on the base body or can be connected to the base body with fastening devices. A fastening device includes as a main component an attachment screw and an attachment nut.

DE 30 36 227 C2 or FR 2 613 739 A1 also describe the general technical field.

However, in practical use, the requirements at a construction site constantly change, for example when a lane restoration progresses and the like. Accordingly, reconfigurations are frequently required where a vehicle retention system with smaller stopping ability must be replaced with a vehicle retention system with a higher stopping ability, or vice versa. This requires considerable time and material.

Moreover, the guide barriers of the aforedescribed type are not very well suited for transport, because they are relatively large and bulky. They therefore require a commensurately large transport space. More particularly, stacking of the conventional guide barriers for transport, during reconfiguration of a construction site, but also for transport over along distances in containers, is difficult.

SUMMARY OF THE INVENTION

Starting from the state of the art, it is therefore an object of the invention to provide a vehicle restraint system which is easier to transport and to assemble and which can also be readily and flexibly adapted to different stopping levels.

According to one aspect of the invention, the object is solved by a vehicle restraint system which includes guide barriers detachably placed side-by-side, wherein each guide barrier includes a housing-type base body that can be placed on the ground and a guide rail arranged above the base body, wherein the guide rail and the base body can be coupled to via tension rods, wherein the guide rail and the base body can be coupled via tension rods, wherein each tension rod is connected with an upper end to the guide rail and can be tensioned with a lower end in an abutment arranged inside the base body. The base body includes inclined roof-shaped lateral impact plates which are connected by a top cover plate. Coupling locations are provided in the cover plate for passing through the tension rods. A corresponding support is provided in the region of a coupling location below the cover plates, with the tension rod guided and supported in the support.

Particular embodiments of the solution according to claim 1 are recited in the dependent claims 2 and 3.

A second solution of the object of the invention is recited in claim 4.

According to one aspect of the invention, the object is solved by a vehicle restraint system which includes guide barriers detachably placed side-by-side, wherein each guide barrier includes a housing-type base body that can be placed on the ground and a guide rail arranged above the base body, wherein the guide rail and the base body can be coupled to via tension rods, wherein the guide rail and the base body are vertically spaced by tubular spacers, wherein the tension rods extend through the spacers and the tension rods can be tensioned with a bottom end in an abutment disposed inside the base body.

Advantageously, each spacer extends from the guide rail to the abutment and is guided into the base body through an opening.

The spacer includes a limit stop which makes contact with the cover plate of the base body. A centering pin is provided at the bottom end of the spacer facing the abutment, with the centering pin engaging in a seat in the region of the abutment. This approach facilitates assembly and improves stability.

The technical relationship between the two standalone solutions resides in the modular construction of the vehicle restraint system, having guide barriers are formed of a base body and guide rails which can be coupled to one another via tension rods.

The guide rail and the base body can be coupled easily and quickly via the tension rods. They can be assembled at the construction site. The invention provides a flexible vehicle restraint system with base bodies that can be assembled into a string and used as standalone components. Depending on the application and the requirements at the site, the base bodies can be supplemented with the upper guide rails for attaining a higher stopping level. This is particularly advantageous for construction sites, in particular for construction sites having curved access roads.

In the context of the invention, a string of guide barriers which only consist of the base bodies can be erected initially. In areas with curved roads or basically on those road segments requiring greater stopping levels, the system is modularly supplemented with the upper guide rails. This can be easily done on site. Large-scale reconfigurations or exchange of one vehicle restraint system for another is not required.

Basically, existing base bodies can also be reconfigured and equipped with upper guide rails, wherein the guide rails are installed on the base bodies according to the invention by using the tension rods.

The vehicle restraint system is also advantageously configured for transport, because the base body and the guide rails can be transported separately. The base body and the guide rails can also be easily stacked. The storage space available on a transport vehicle or in a container can then be used economically. Assembly is performed only on-site.

The guide rails are coupled to the base bodies via the tension rods. To this end, the tension rods are tensioned with the abutments provided in or on the base body. This can be done, for example, by rotating the tension rods. The abutment is arranged inside the base body.

Within the context of the invention, in particular threaded rods are used as tension rods. The threaded rods have at least one rod section with a thread, with which the threaded rod can be tensioned in the abutment disposed in the base body. This is preferably an external thread, in particular a coarse thread. The abutment has a corresponding internal thread. The guide rail and the base body are pulled against each other and tensioned by rotating the threaded rod. The tension rods or threaded rods are operated from their respective top end. To this end, the threaded rods have a rod head to which a handle for rotating the threaded rods can be connected. Advantageously, the top end of the threaded rod extends through the guide rail.

Depending on the intended use and stopping level, two superpositioned guide rails may also be provided. Preferably, the guide rails have a round or rectangular cross-section. Advantageously, the guide rails have profiled sidewalls. This can increase the section modulus and stiffness of the guide rails.

In addition, guard planks extending in the longitudinal direction can be installed on the guard rails.

Transverse movement of the vehicle restraint system and of the guide barriers, respectively, can be reduced by providing friction-enhancing means on the bottom side of the base bodies. The friction-enhancing means can be formed by shoes which formfittingly encompass bottom-side runners of the base bodies. Preferably, such shoes are made of an elastomer, in particular rubber or polyurethane.

The friction-enhancing means are preferably formed by friction coverings, in particular patterned friction coverings arranged at the bottom side on the base body. Preferably, the friction-enhancing means are coupled at least indirectly with a tension rod, wherein the pressing force of the friction-enhancing means against the ground can be adjusted with the tension rod. In this way, the protection of the vehicle restraint system against transverse displacement can be varied according to the local conditions.

The base bodies can also be mounted on rails which are placed stationarily on the ground. The base bodies have limited transverse motion along the rails. The base bodies are clamped to the rails, allowing displacement along the rails only after presettable transverse forces are exceeded. In this way, the vehicle restraint system can be laterally displaced in a limited way when load limits are exceeded. After a maximal lateral displacement is reached, the vehicle restraint system assumes the entire stopping power.

The base bodies which abut one another in the longitudinal direction, as well as the guide rails, can be coupled via plug connections.

To this end, each base body has on a first end face an insertion pocket and on the other second end face an insertion tab. When two base bodies are coupled to one another, the insertion tab of one base body engages with the insertion pocket of the adjacent base body. The insertion pocket is formed by a front butt plate which is spaced from the first end face by two vertical ribs. The insertion tab is formed in the second end face between two vertical slots.

The connection between the two base bodies can be further improved by providing pin-shaped projections on the second end face of the base body facing the ground. Recesses are provided on the first end face of the base body in the bottom web of the insertion pocket. When two base bodies are coupled to one another, the projections on the second end face engage with the recesses of the insertion pocket. Preferably, the projections and the recesses are arranged in the outer marginal regions of the respective insertion pocket and the second end face. This ensures a stable connection between two base bodies capable of withstanding large bending moments.

The cover plates of two abutting base bodies are connected with each other via a plug plate which overlaps the butt joint. The plug plate has a plate body with two cross ribs projecting from the plug plate at right angles. The plug plate is inserted in matching seats in the cover plates and it is flush with the surface of the cover plates.

Two guide rails abutting one another in the longitudinal direction can also be coupled by way of a plug connection, wherein the plug connection is formed, on one hand, by an angle profile provided on the end face of the guide rail and, on the other hand, by a coupling rib disposed in the transverse plane on the adjacent end face of the following guide rail.

The coupling between the individual guide barriers can be easily assembled, is stable and permits limited angular arrangement of the guide barriers relative to one another. This is desirable in particular at construction sites so as to conform to curves.

To improve the steadiness and in particular resistance against transverse displacement of the vehicle restraint system, one or more weighting bodies may be arranged in the base body. These can be heavy solid bodies, for example made of concrete. Advantageously, the side of the weighting bodies facing the ground can be provided with friction-enhancing means.

For weighting down the vehicle restraint system, fillable containers may be provided in the base body. The containers may include containers with solid walls, for example jerry-can type containers, but also flexible containers, for example fillable tubes, bags or pillows. Preferably, the containers have a filler neck which is accessible through an opening in the cover plate. Advantageously, the bottom side of the containers may also be provided with friction-enhancing means. The fill material may include, for example, sand or water or similar flowable or pourable materials.

The basic body may include support plates oriented outwardly from the impact plates. Angle rails extending in the longitudinal direction of the base body are arranged below the support plates. Several profile bodies which are spaced apart in the longitudinal direction and made of plastic or rubber are attached to the angle rails. The profile bodies increase the friction resistance between the base bodies and the ground. Because the profile bodies are spaced apart relative to one another, water can readily circulate.

The profile bodies have a longitudinal slot for attachment on the angle rail, with the slot encompassing the free longitudinal leg of an angle rail.

BRIEF DESCRIPTION OF THE DRAWING

The invention will now be described in more detail with reference to the exemplary embodiments illustrated in the drawings.

FIG. 24 shows in a perspective view the respective end sections of two base bodies;

FIG. 25 shows the details A and B of FIG. 24 on an enlarged scale;

FIG. 26 shows a side view of the embodiment illustrated in FIG. 24;

FIG. 27 shows a top view of the embodiment illustrated in FIG. 24;

DETAILED DESCRIPTION OF PREFERRED EMBODIMENTS

Figure 1:
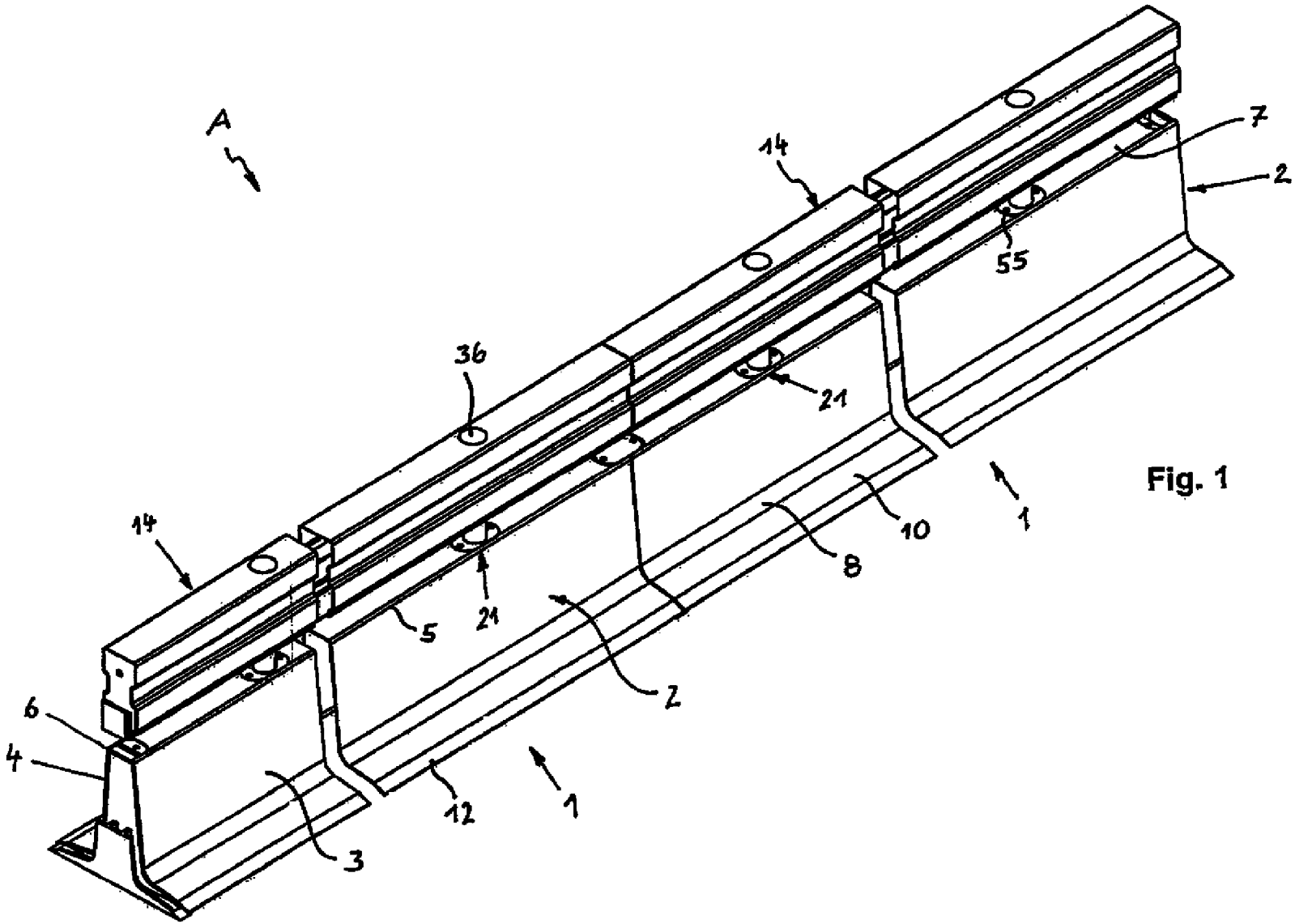
FIG. 1 shows in a perspective view a detail of a vehicle restraint system according to the invention.
Figure 2:
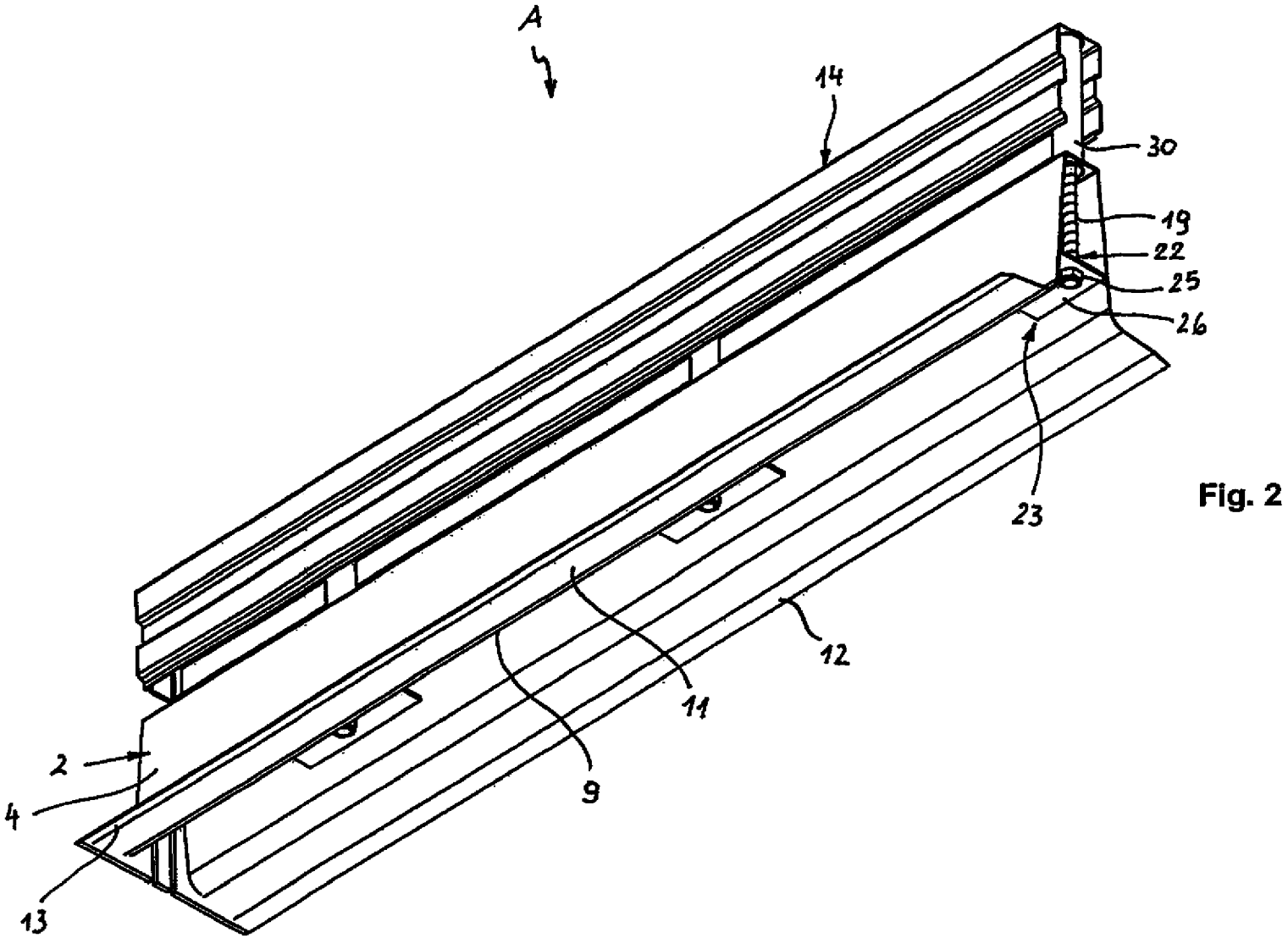
FIG. 2 is a detail of FIG. 1 as viewed at an angle from below.
Figure 4:
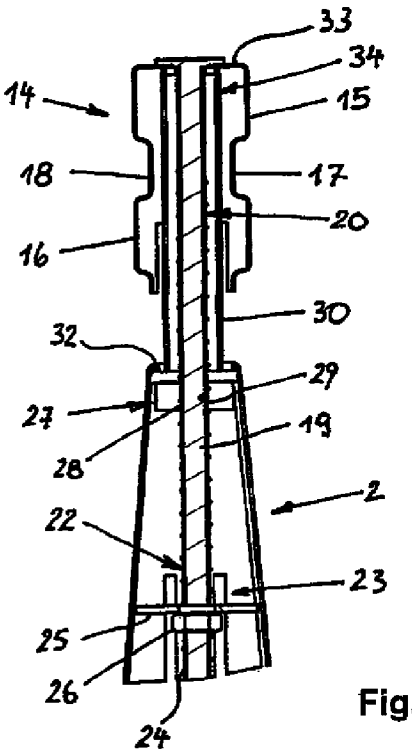
FIG. 4 shows a detail of the vehicle restraint system in a vertical section.
Figure 3:
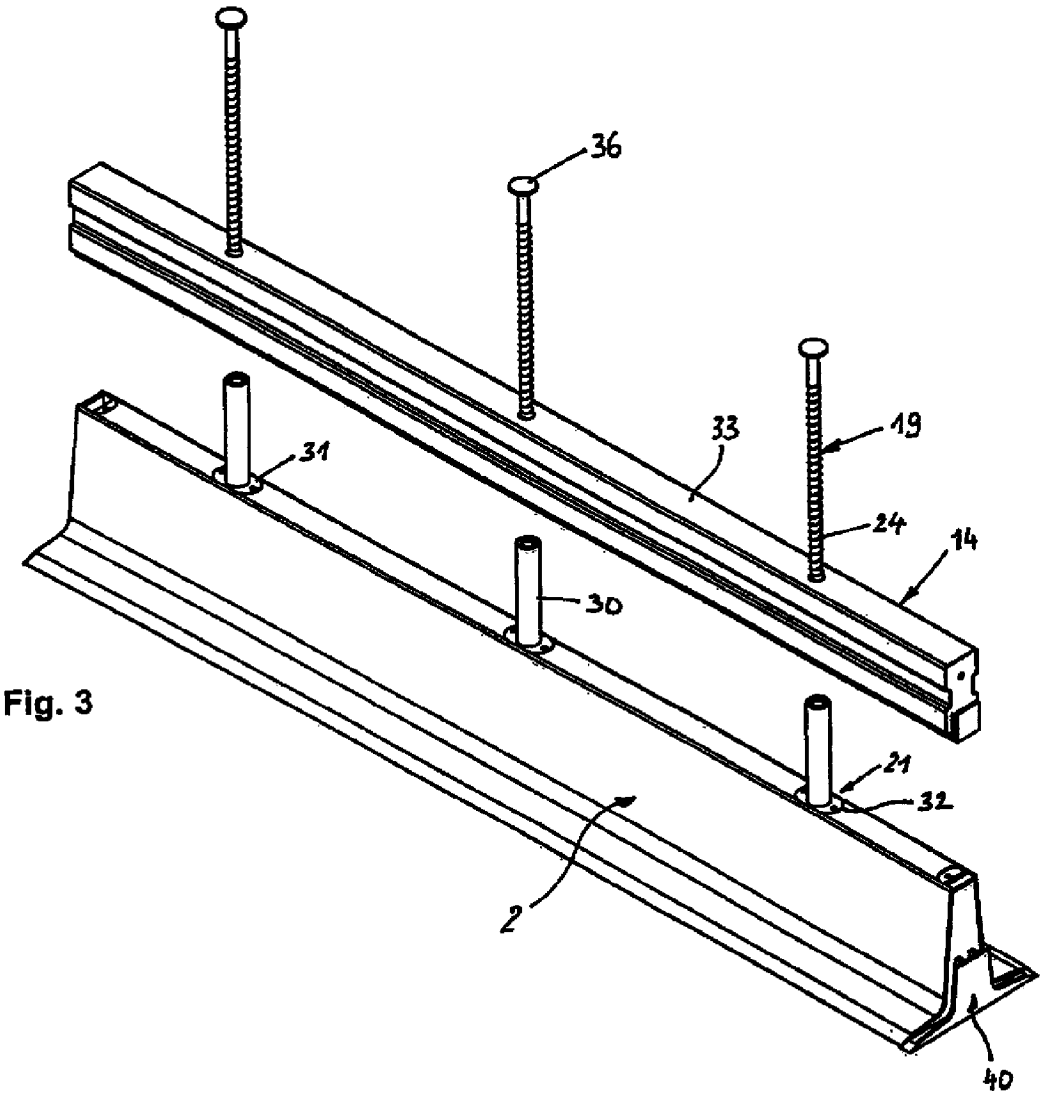
FIG. 3 is again a perspective view of the vehicle restraint system with a partially exploded view of its components.
Figure 5:
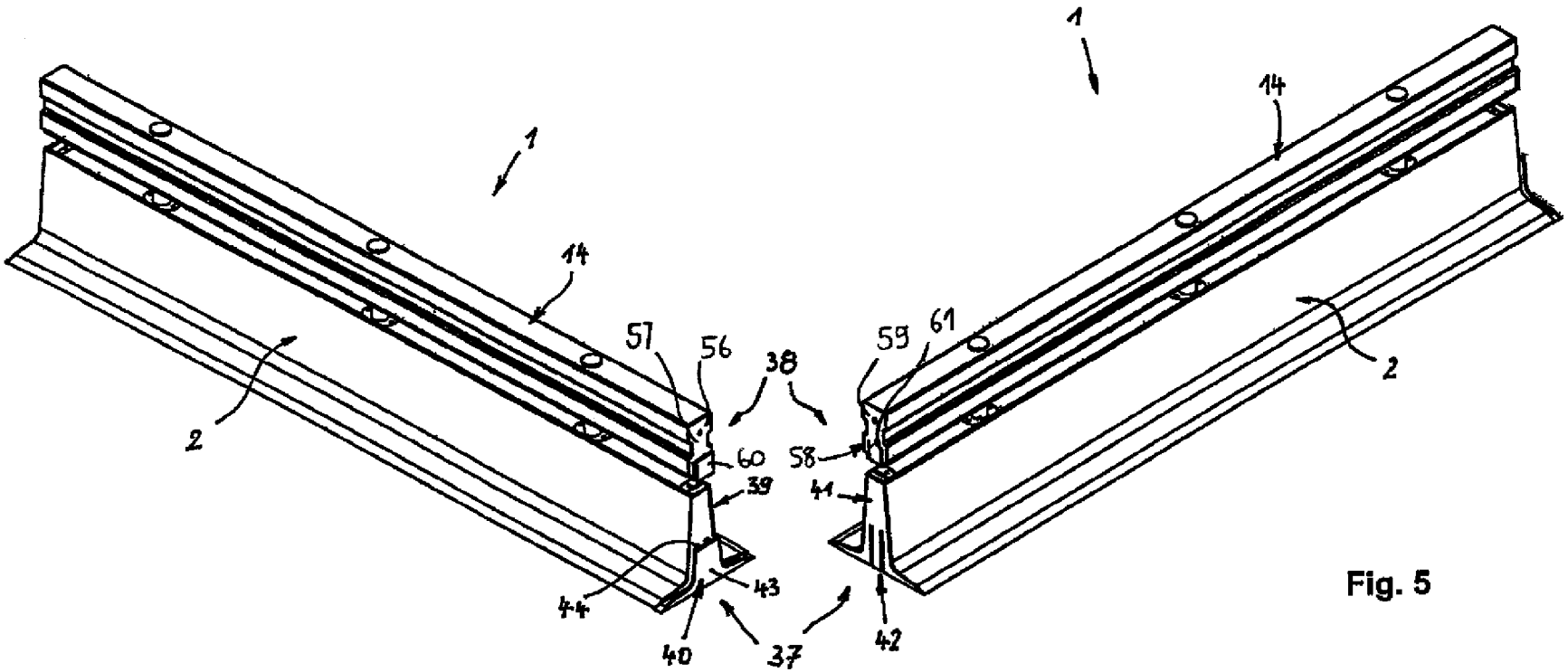
FIG. 5 shows to guide barriers of the vehicle restraint system ready to be coupled.

FIG. 1 shows a first embodiment of a vehicle restraint system A according to the invention, which is constructed of detachable guide barriers 1 placed side-by-side. Details of the guide barriers 1 are described in FIGS. 2 to 5.

Each guide barrier 1 has a housing-type base body 2, which can be placed on the ground, with roof-shaped inclined lateral impact plates 3, 4, a cover plate 7 connecting the upper longitudinal edges 5, 6 of the impact plates 3, 4, and support plates 10, 11 arranged on the lower longitudinal edges 8, 9 of the impact plates 3, 4 and extending outwardly from the base body 2. The marginal regions 12, 13 of the support plates 10, 11 are slightly bent downwardly.

A respective guide rail 14 extends above the base body 2 of a guide barrier 1 with a spacing therebetween, wherein the guide rail 14 has a C-shape profile which is open towards the bottom. The side walls 15, 16 of the longitudinal rail 14 have a profile in form of longitudinal channels 17, 18.

The guide rails 14 and the base body 2 are detachably connected with one another by tension rods implemented as threaded rods 19. Each threaded rod 19 extends with its upper end 20 through the guide rail 14. Coupling locations 21 for passing the threaded rod 19 through are provided in the cover plate 7 of the base body 2. The threaded rods 19 are inserted in the base body 2 at the coupling locations 21 and tensioned with their lower end 22 in an abutment 23 disposed in the base body 2. The threaded rods 19 have an external thread 24 in form of a coarse thread. The abutment 23 is formed by an abutment plate 25 secured in the lower third of the base body 2 transversely between the impact plates 3, 4 and a threaded nut 26 arranged below the abutment plate 25. A corresponding plate-shaped support 27 with a bore 28 with an internal thread 29 is provided in the region of the coupling locations 21 below the cover plate 7. Each threaded rod 19 is a guided and supported with its external thread 24 in the internal thread 29 of the support 27.

The threaded rods 19 extends in the longitudinal direction through tubular spacers 30 which are arranged between the guide rail 14 and the base body 2 to space them apart in the vertical direction. The spacers 30 have bottom support surfaces 31. The spacers 30 are supported with the support surfaces 31 in seats 32 provided in the cover plates 7 at the coupling locations 21.

The guide rails 14 which have a C-shaped cross-section and are open towards the bottom encompass the spacers 30 and rest with their horizontal leg 33 connecting the side walls 15, 16 on the upper ends 34 of the spacers 30.

Figure 9:
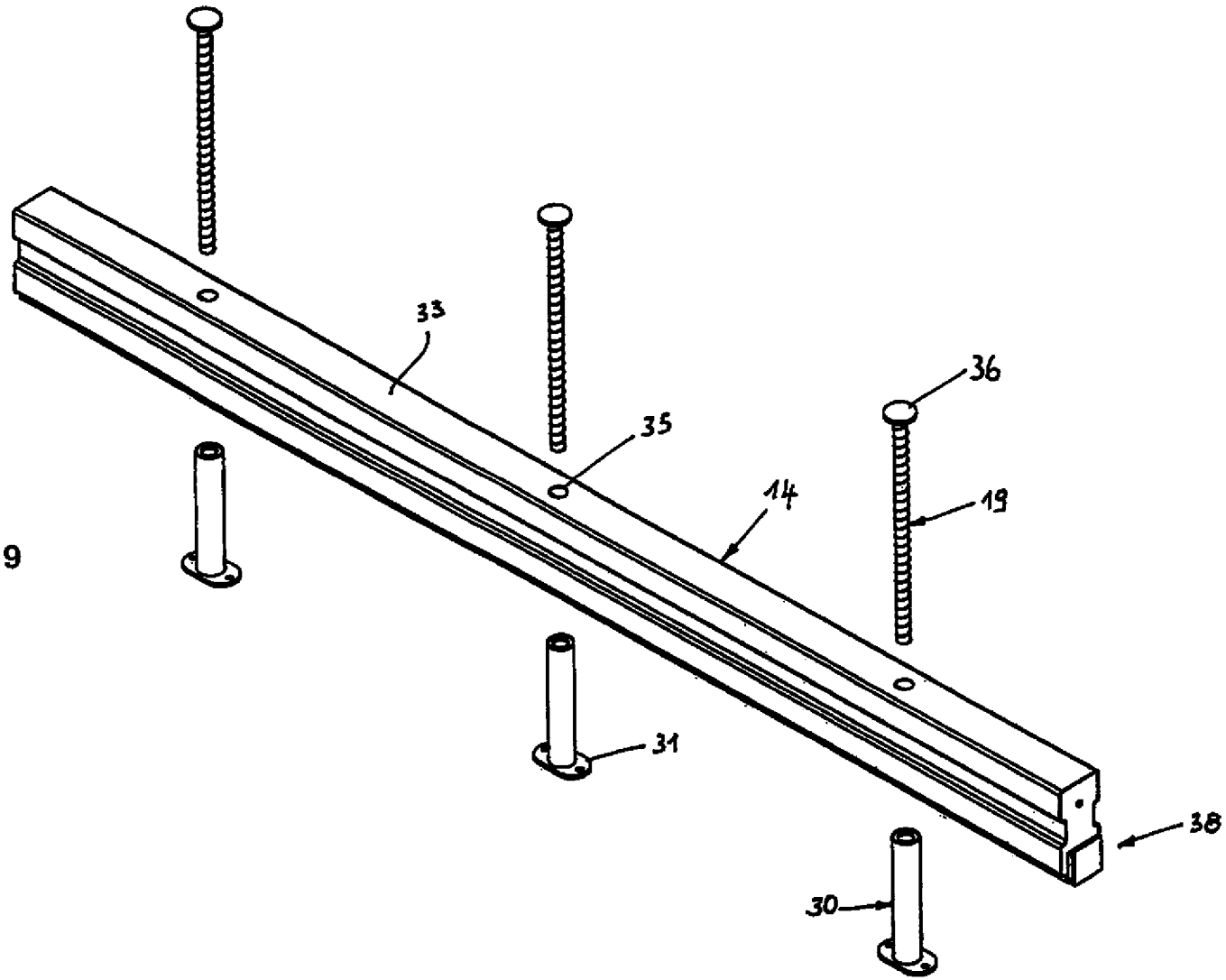
FIG. 9 shows in an exploded view an upper guide rail with three tension rods and spacers.

The guide rails 14 are mounted on the base bodies 2 by inserting the threaded rods 19 in the base body 2 through openings 35 (see also FIG. 9) in the horizontal legs 33 and through the guide rails 14 and the spacers 30 and tensioning them in the abutment 23. This is a done by rotating the threaded rods 19 by way of a rod head 36 provided on the upper end 20, which has suitable wrench faces (not illustrated in detail), for example an internal hexagon, for engaging a handle. In the installed state, the rod head 34 is flush with the surface of the horizontal leg 33 or is recessed and covered with a cap.

The individual guide barriers 1 can be assembled on-site to form the vehicle restraint system A. Base bodies 2 abutting in the longitudinal direction as well as a guide rails 14 abutting in the longitudinal direction are coupled via plug connections 37, 38. Fundamentally, a string of base bodies 2 can be initially assembled and placed side by side. If needed, this string can be supplemented by upper guide rails 14 at locations with higher risk, where a greater stopping level is required. This can be accomplished quickly and with relatively low complexity in the assembly on-site with the threaded rods 19.

The assembly of the vehicle restraint system A will now be described again with reference to the embodiments illustrated in FIGS. 6 to 9.

Figures 6, 7:
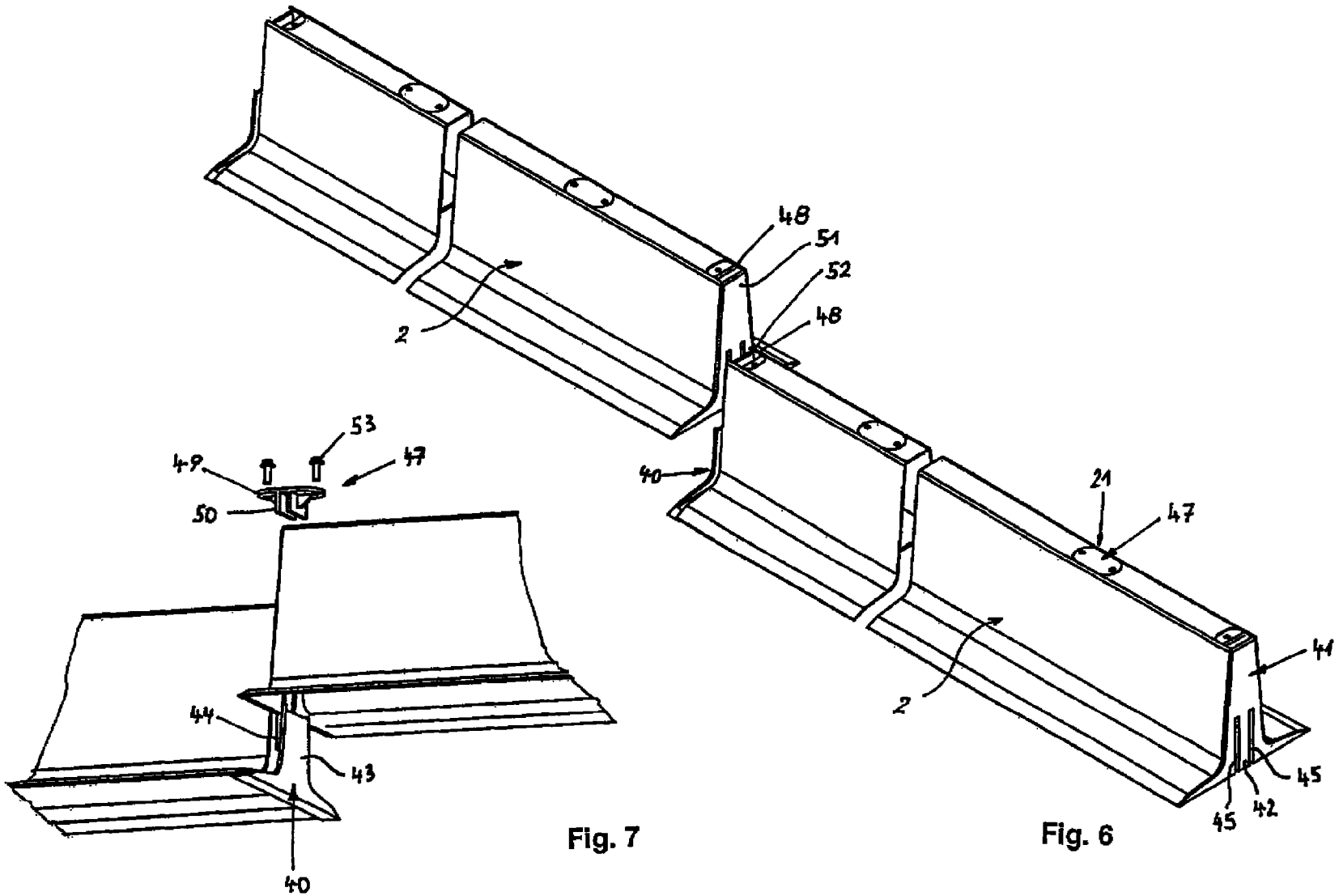
FIG. 6 shows in a perspective view two based bodies during the coupling process.
FIG. 7 shows the connection region between the guide barriers according to FIG. 6 in a different perspective.
Figure 8:
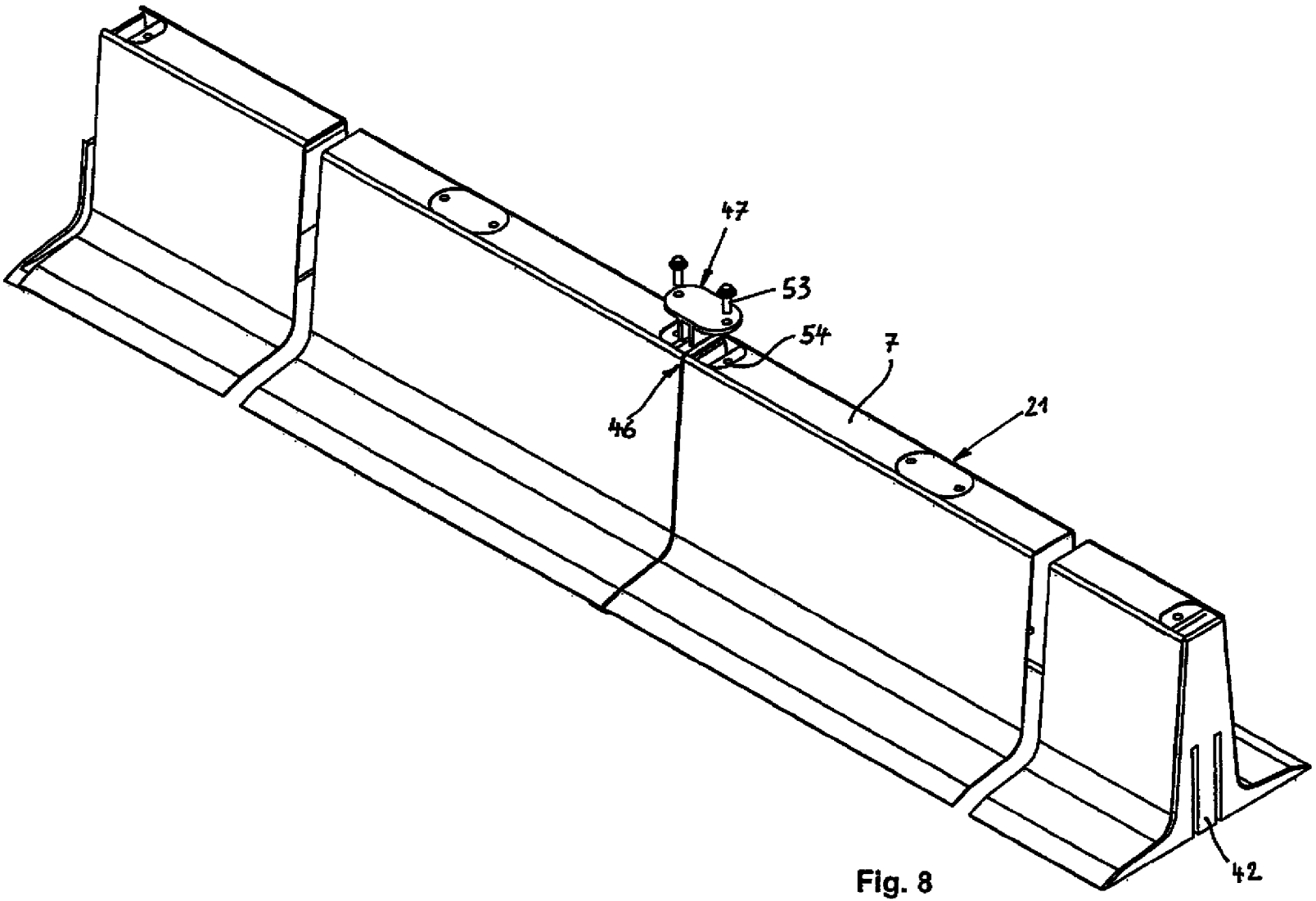
FIG. 8 shows the two base bodies illustrated in FIG. 5 in a coupled state.

FIGS. 6 and 7 illustrate the coupling process between the base bodies 2 of two guide barriers 1. Each base body 2 has on a first end face 39 an insertion pocket 40 and on the other second end face 41 an insertion tab 42. The insertion pocket 40 is formed by a front butt plate 43 which is spaced from the first end face 34 by two vertical ribs 44. The insertion tab 42 is formed in the second end face 41 between two vertical slots 45. The two base bodies 2 are coupled by inserting the insertion tab 42 of one base body 2 into the insertion pocket 40 of the adjacent base body 2. The vertical slots 45 encompass the vertical ribs 44, thereby establishing the plug connection 37.

The cover plates 7 of the two abutting base bodies are connected with each other by a plug plate 47 overlapping the butt joint 46, which are inserted in seats 48 in the joint region of the cover plates 7. The plug plate 47 has a plate body 49 with two cross ribs 50 projecting at right angles. The cross ribs 50 engage behind the facing front plates 51, 52 of the base body 2, thereby ensuring a formfitting coupling. The plug plates 47 are secured by threaded bolts 53 which are threaded into threaded bores 54 in the region of the seats 48. The plug plates 47 can also be used for covering the seats 32 of unused coupling locations 21.

The string of guide barriers assembled from base bodies 2 satisfies at least the requirements of DIN EN 1317 with respect to the impact test TB21 and hence also the stopping level T1. For upgrading to a stopping level H2, the string of guide barriers is augmented and supplemented by upper guide rails 14. The required components are again illustrated in FIG. 9. The spacers 30 are mounted on the base bodies 2. To this end, the plug plates 47, which cover the seats 32 at the coupling locations 21, are removed and the spacers 30 are placed with their support surfaces 31 into the seats 32 and secured with screws 55. Thereafter, the guide rail 14 is placed on the spacers 30 and tensioned with respect to the base body 2 with the threaded rods 19.

The plug connection 38 between two guide rails 14 abutting one another in the longitudinal direction consists, on one hand, of an angle profile 56 provided on one end face 57 of the guide rail 14 and, on the other hand, of a coupling web 58 located on the opposite second end face 59 of the guide rail 14. The angle profile 56 has a vertical leg 60 which protrudes through two vertical ribs (not visible in the drawings) from the end face 57 of the guide rail 14. On the left and right side of the coupling web 58 there are provided two vertical slots 61, which are guided via the vertical ribs on the adjacent end face 57 when the plug connection 38 is established, so that the coupling web 58 engages behind the vertical leg 60. This ensures reliable coupling between the guide rails 14. In addition, a screw connection can be provided between the end faces 57 and 59 of the guide rails.

Figure 11:
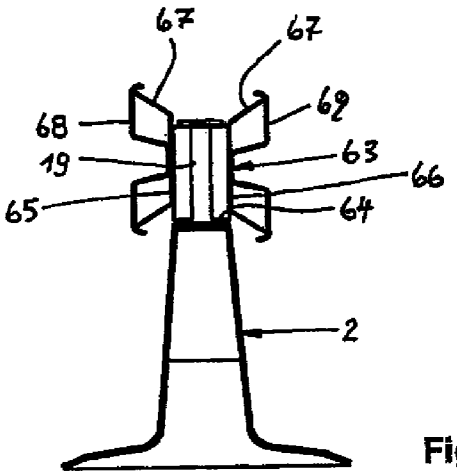
FIG. 11 is a frontal view of the embodiment illustrated in FIG. 10.
Figure 10:
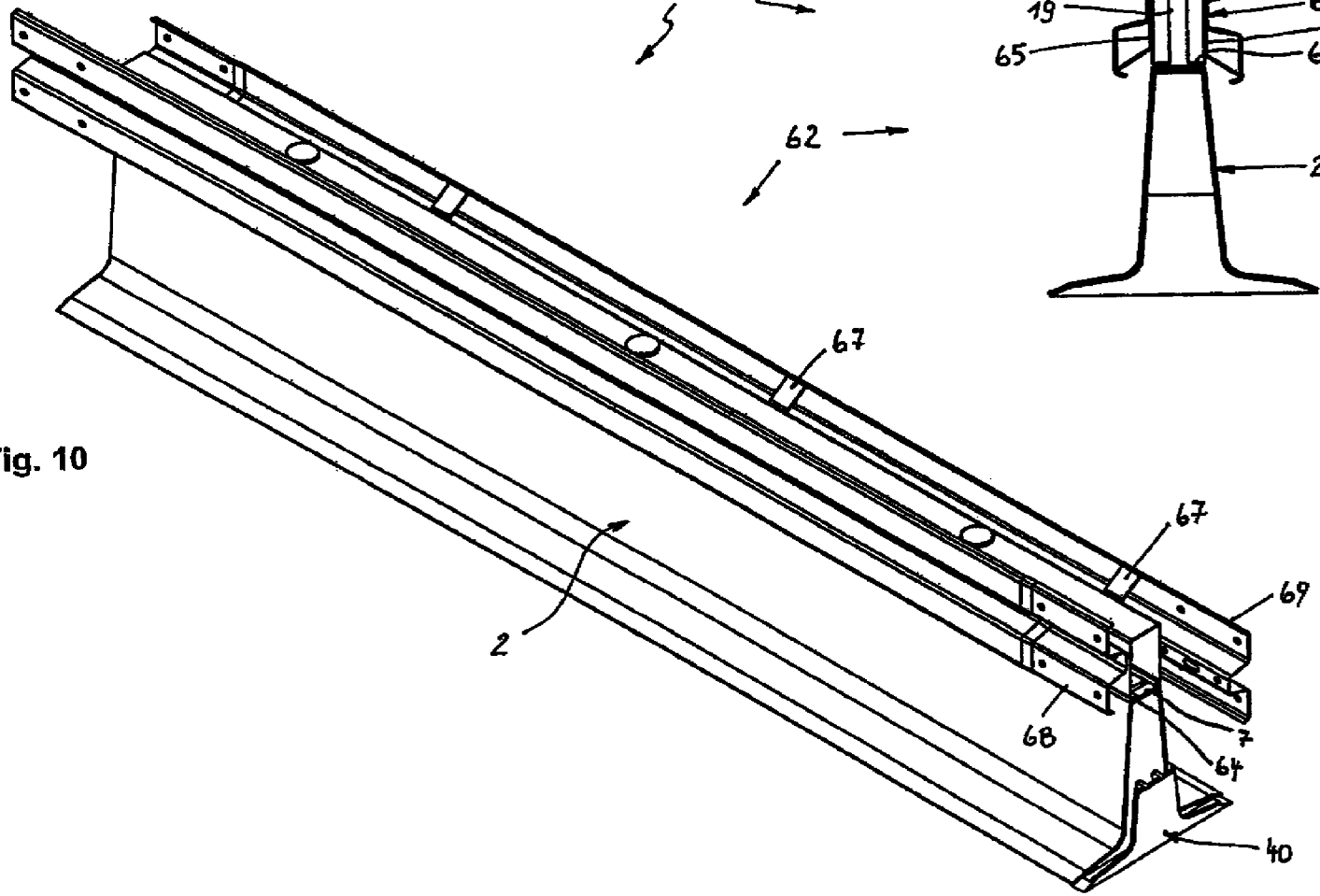
FIG. 10 shows another embodiment of a vehicle restraint system according to the invention in a perspective view.

FIGS. 10 and 11 show another embodiment of a vehicle restraint system A.

The guide barrier 62 of the vehicle restraint system B has a base body 2 corresponding to the aforedescribed embodiment. Identical components are therefore indicated with the same reference symbols. A guide rail 63 is arranged above the base body 2. The guide rail 63 and the base body 2 can be connected, as described above, with threaded rods 19. Unlike the vehicle restraint system A, the guide rail 63 is placed directly on the base body 2 without interposed spacers. The guide rail 63 which has a C-shaped cross-section is supported on the cover plate 7 of the base body 2 by lower inwardly oriented marginal legs 64 located at the bottom. W-shaped guard planks 68, 69, which extend in the longitudinal direction of the guide rail 63 or the guide barrier 62, are mounted on the side walls 65, 66 of the guide rail 63, with support profiles 67 arranged therebetween.

Figure 12:
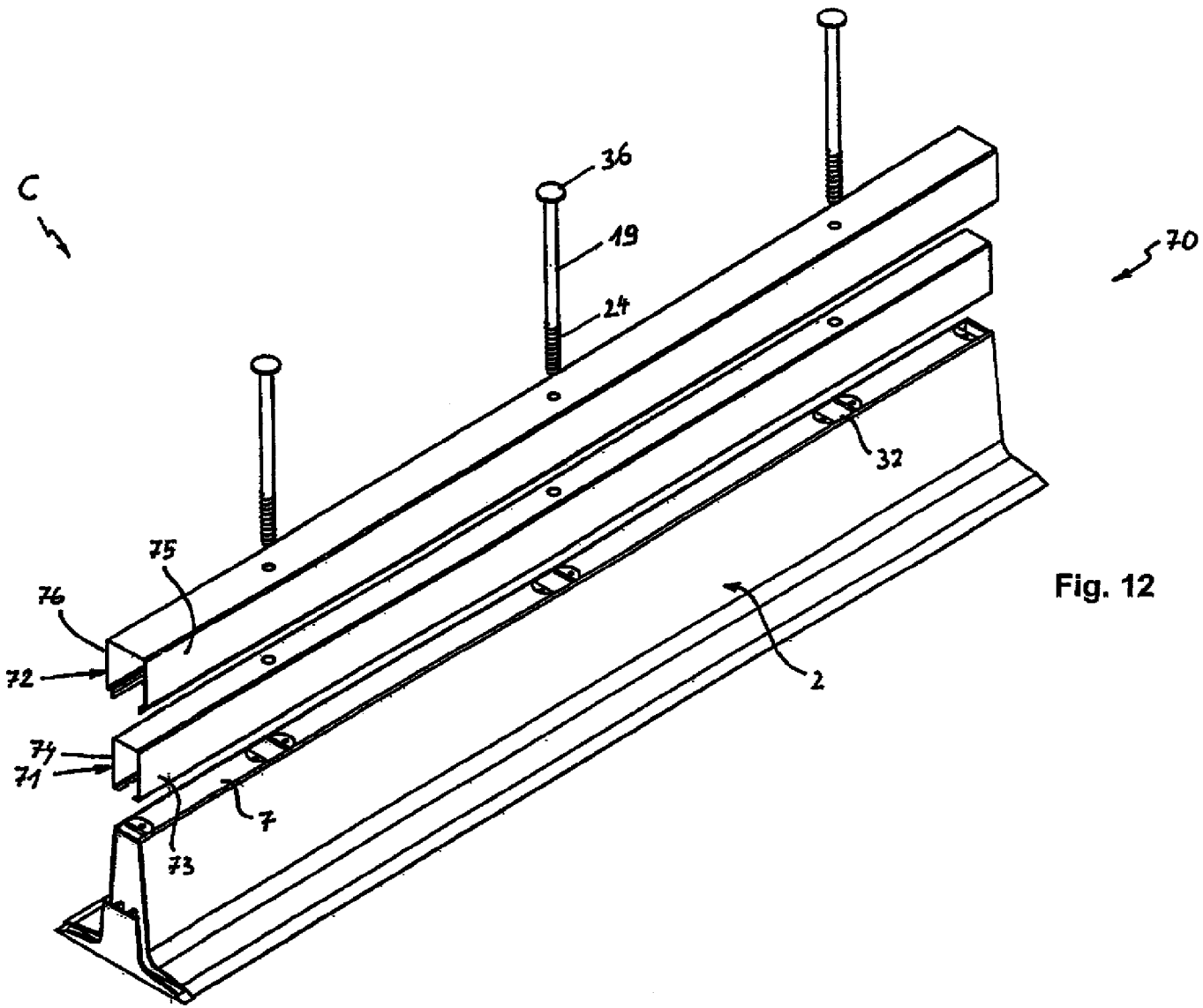
FIG. 12 is again a perspective view of another embodiment of a vehicle restraint system according to the invention with a stretched exploded view of its components.
Figure 13:
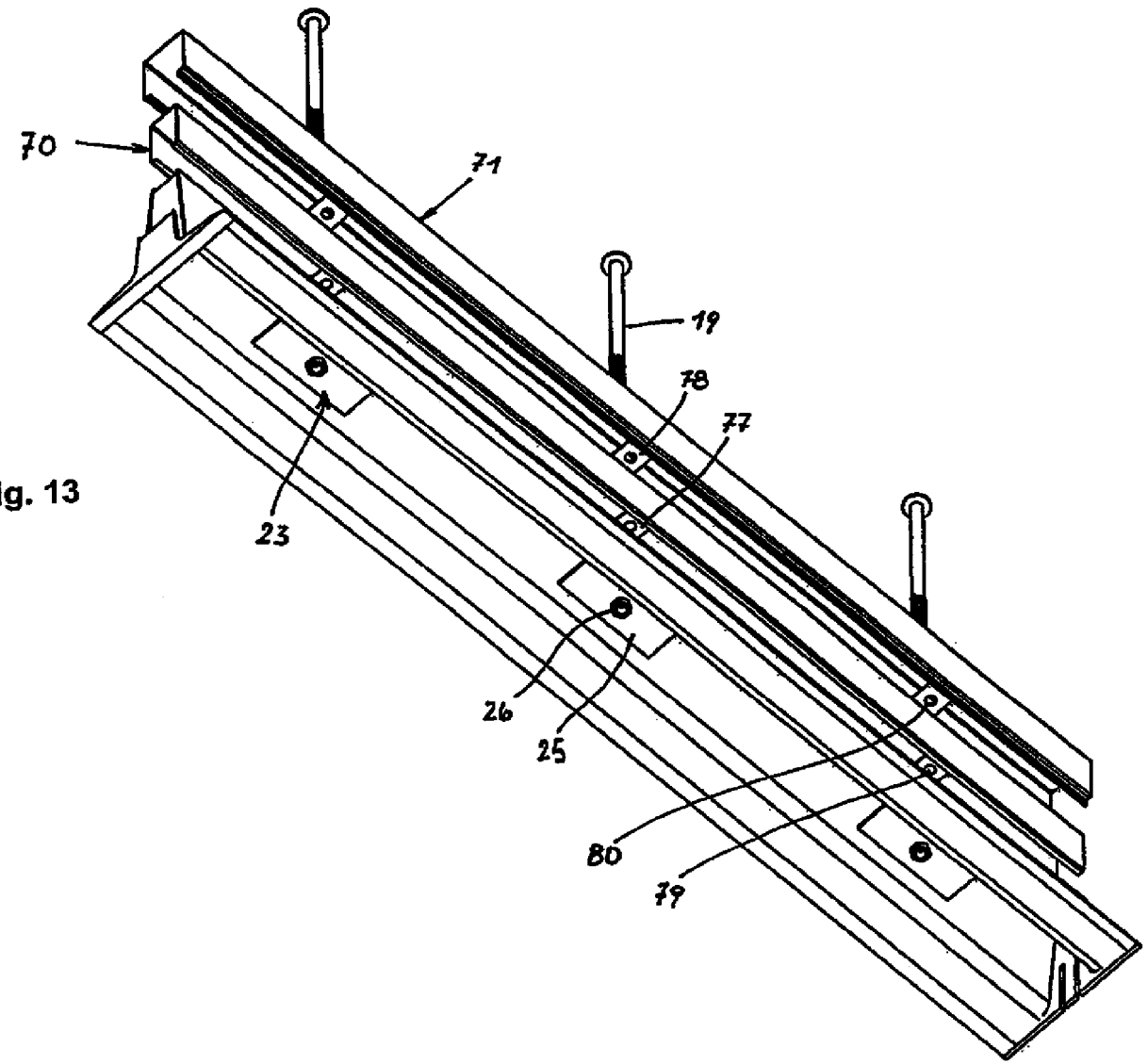
FIG. 13 shows the vehicle restraint system according to FIG. 12 viewed at an angle from below.
Figure 14:
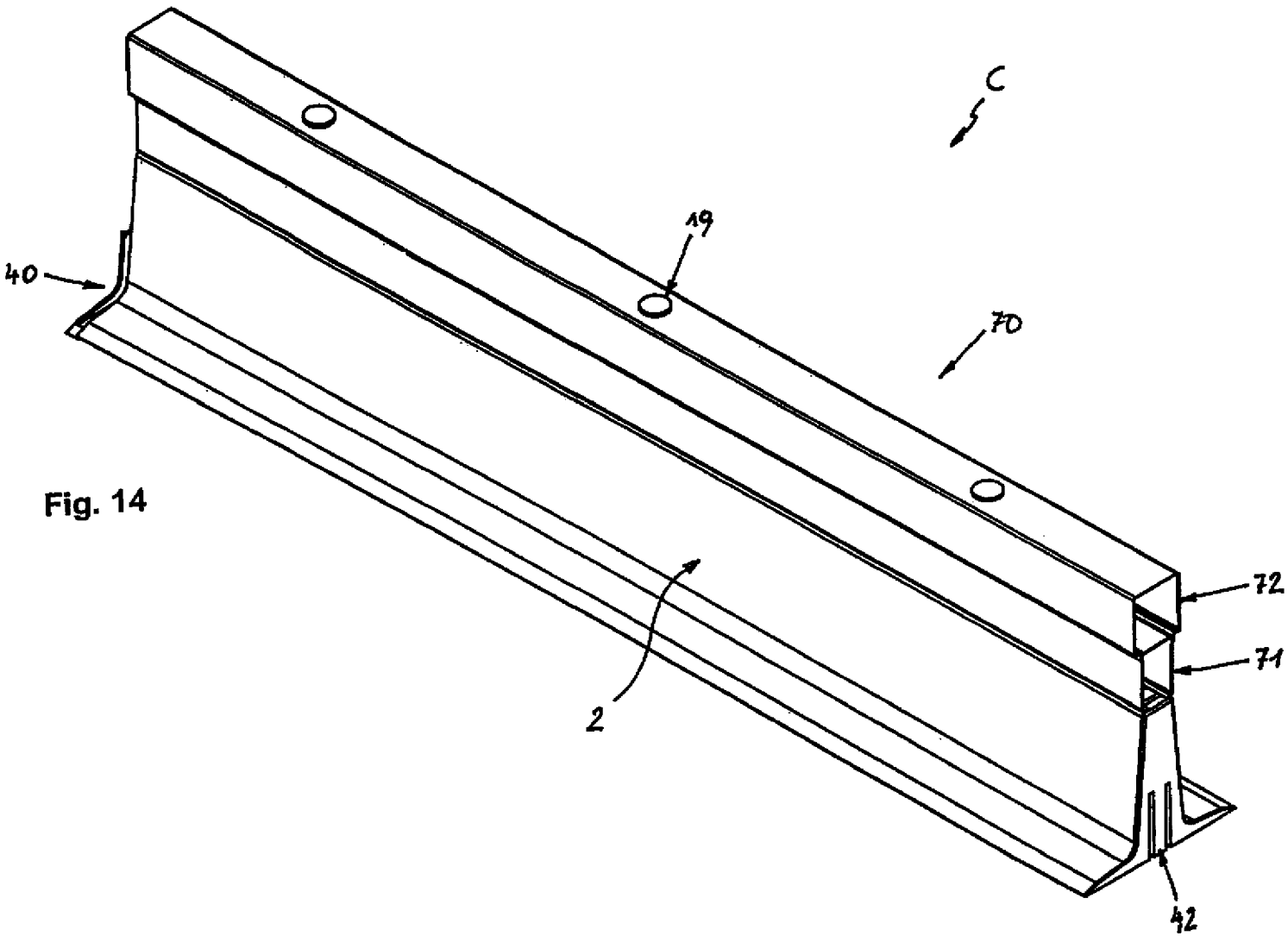
FIG. 14 shows the vehicle restraint system according to FIGS. 12 and 13 in a perspective view after assembly.

The vehicle restraint system C illustrated in FIGS. 12 to 14 also includes guide barriers 70 with base bodies 2. Upper guide rails 71, 72 are coupled to the base bodies 2 by way of threaded rods 19. Unlike the aforedescribed embodiments, the vehicle restraint system C has two guide rails 71, 72 which are arranged on top of one another and tensioned with respect to the base bodies 2 by the threaded rods 19. Tensioning is performed, as before, by way of the abutments 23 arranged in the base bodies 2, into which the threaded rods 19 are screwed.

The guide rails 71, 72 also have a C-shape configuration and are arranged so as to be open towards the bottom, wherein the sidewalls 73, 74 or 75, 76 are connected by cross ribs 77, 78, as indicated in FIG. 13. The cross ribs 77, 78 have openings 79, 80 for guiding the threaded rods 19.

Figure 15:
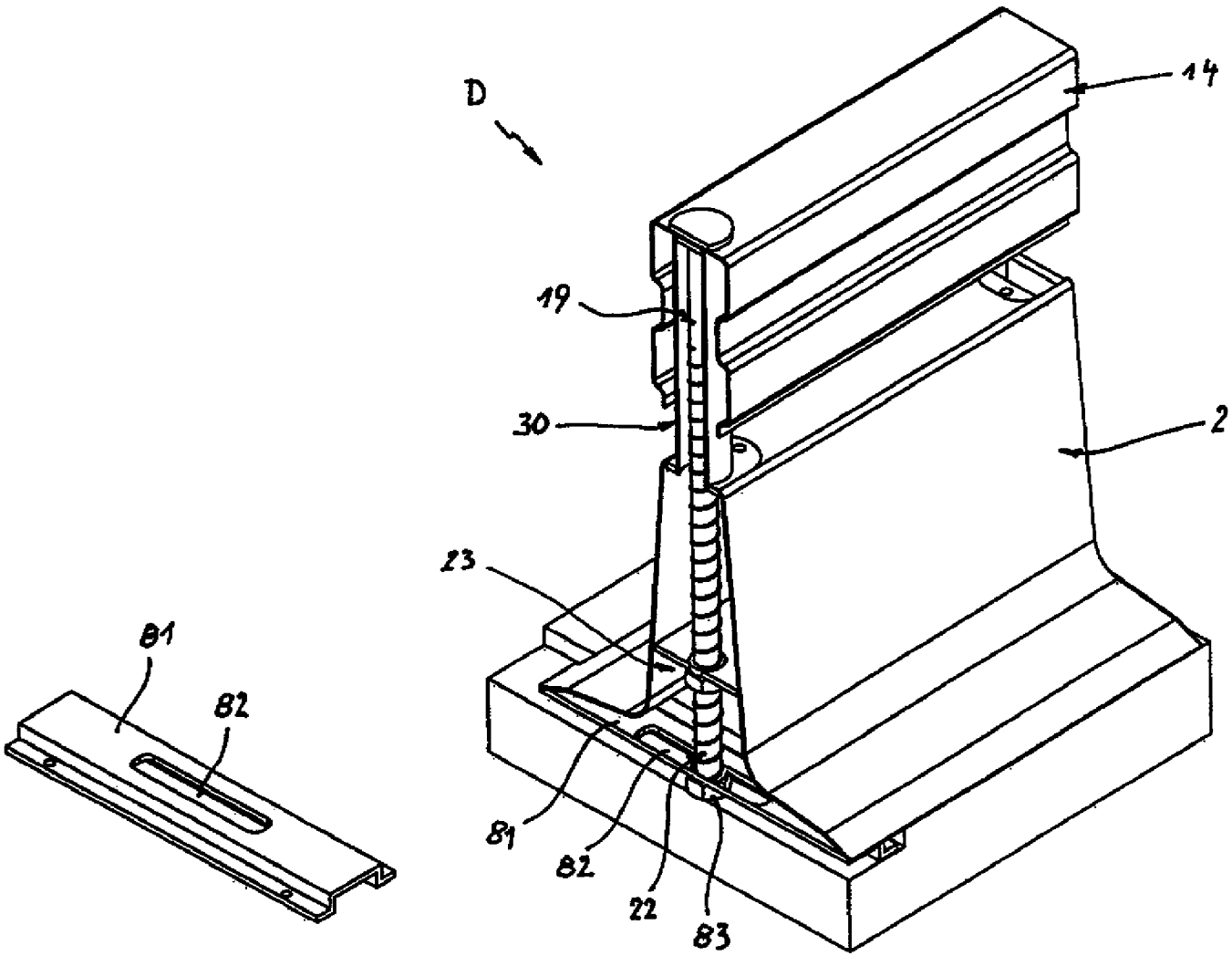
FIG. 15 shows once more in a perspective view a detail of a vehicle restraint system.

The general construction of the vehicle restraint system D of FIG. 15 corresponds in that of the vehicle restraint system A, as described above with reference to FIGS. 1 and 9. The same components and parts of components are therefore indicated with identical reference symbols. Unlike the vehicle restraint system A, the base bodies 2 in the vehicle restraint system D are mounted on rails 81 which are secured on the ground. The rails 81 have longitudinal slots 82. The threaded rods 19 are guided with their bottom end 22 through the abutment 23 and the longitudinal slot 82, where they are tensioned with the threaded nut 83, with the threaded rod 19 attached to the rail 81 assuming the function of the abutment in the base body 2.

The guide barriers 1 of the vehicle restraint system D are limited in their transverse displacement on the rails 81, until the travel provided in the longitudinal slots 82 is exhausted. Thereafter, the vehicle restraint system D is rigid.

Figure 17:
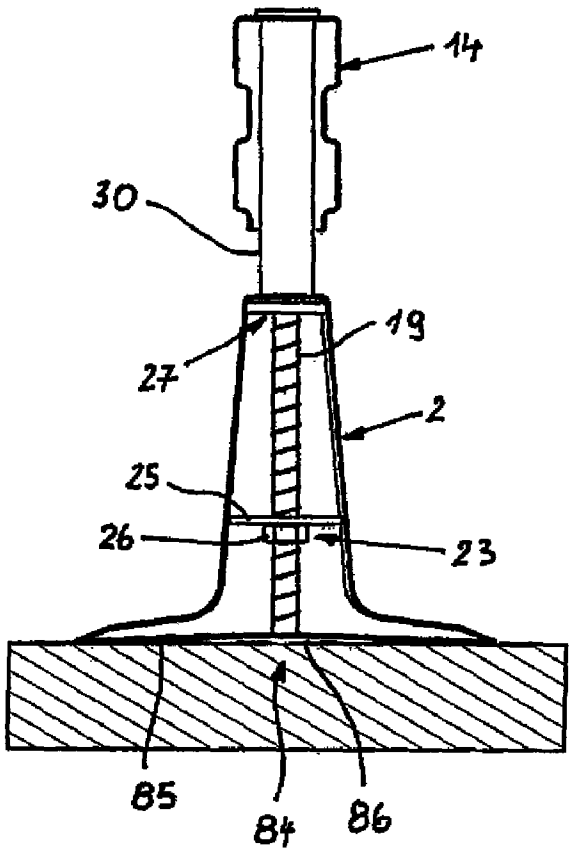
FIG. 17 shows the vehicle restraint system illustrated in FIG. 16 with friction-enhancing means pressed against the bottom side.
Figure 16:
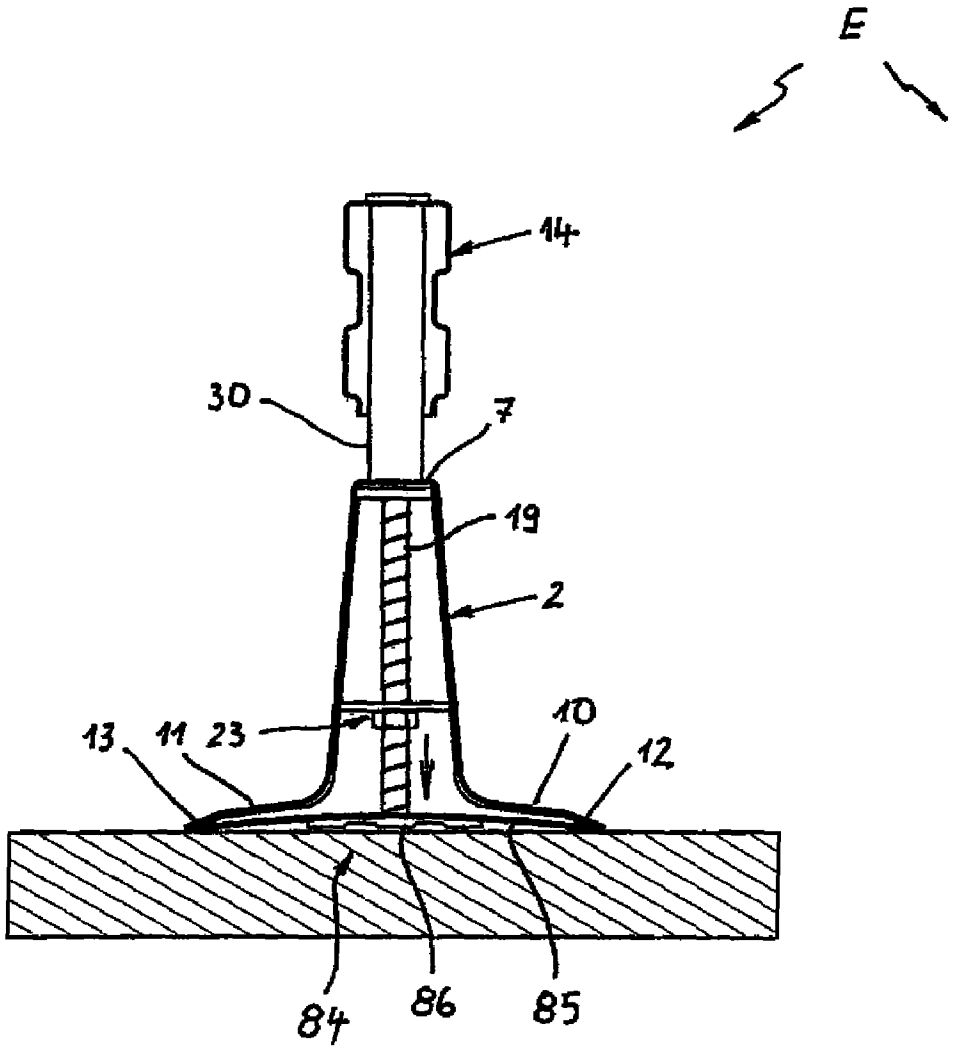
FIG. 16 shows in a cross-sectional view a vehicle restraint system with friction-enhancing means arranged on the bottom side.
Figure 20:
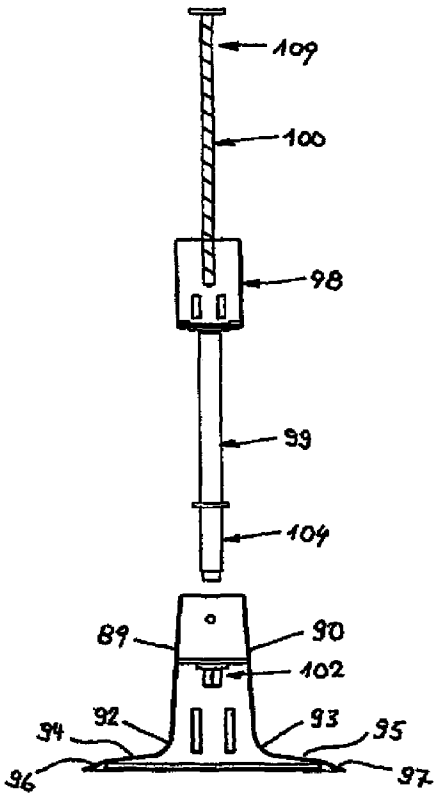
FIG. 20 shows a frontal view of the embodiment illustrated in FIG. 17.
Figure 19:
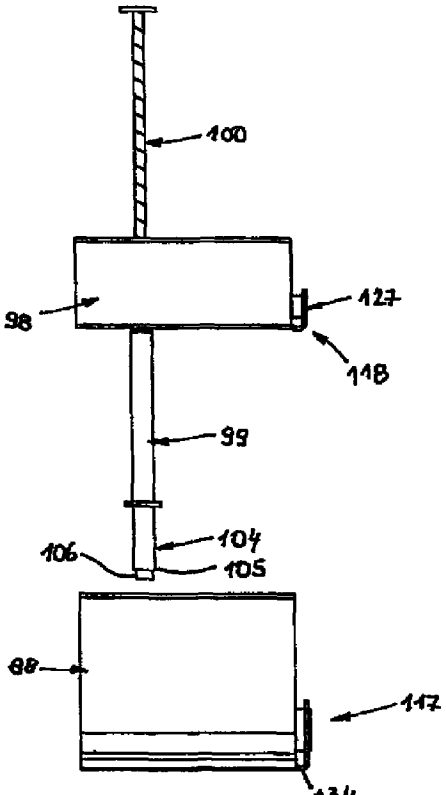
FIG. 19 shows a side view of the embodiment illustrated in FIG. 17.
Figure 18:
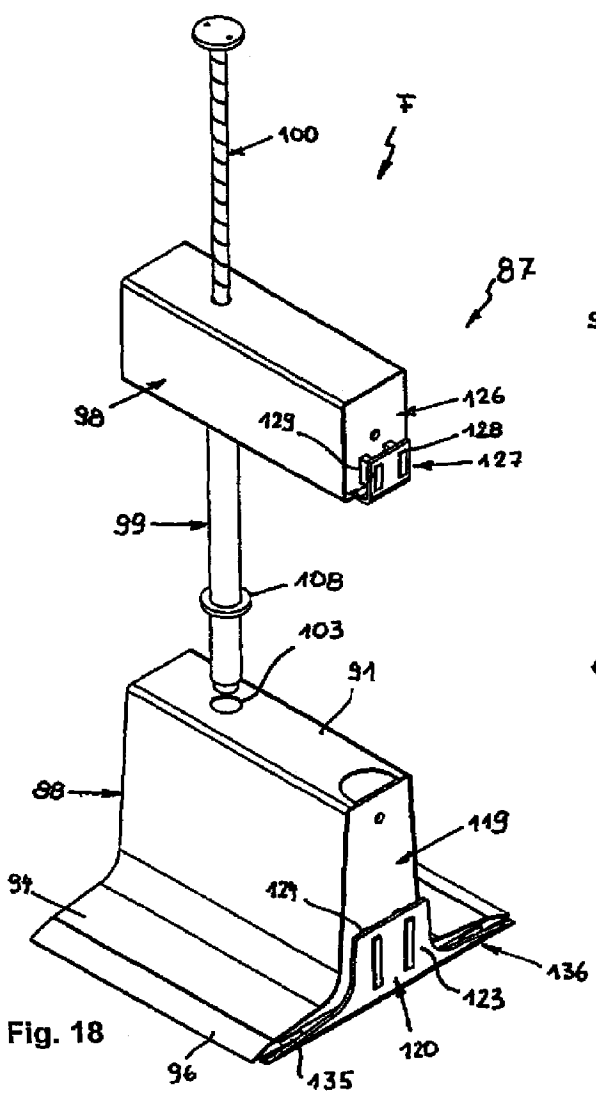
FIG. 18 shows in a perspective view an end section of a guide barrier in another embodiment of a vehicle restraint system according to the invention.
Figure 23:
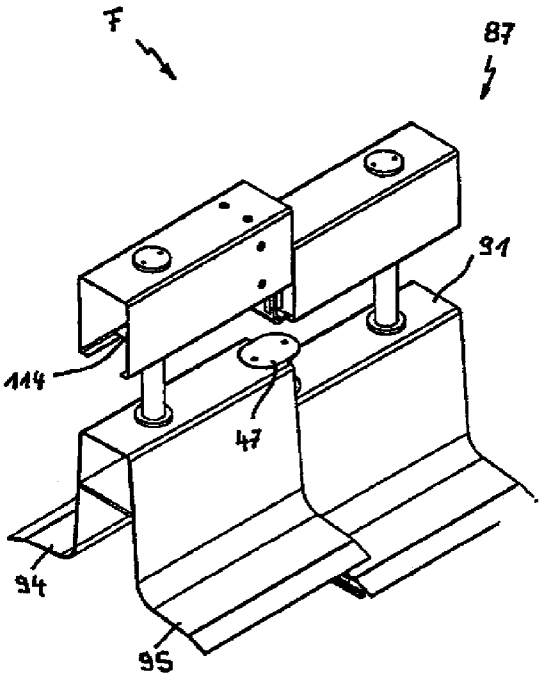
FIG. 23 shows a perspective view of the embodiment illustrated in FIG. 21.
Figure 22:
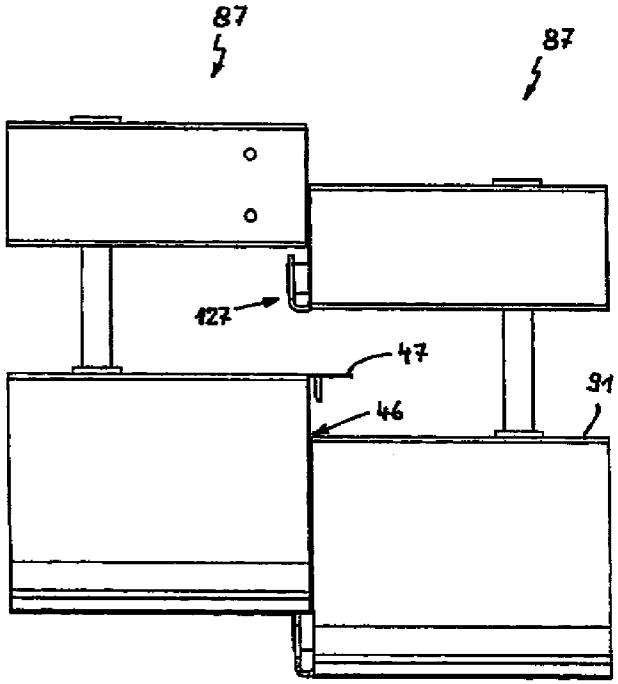
FIG. 22 shows a side view of the embodiment illustrated in FIG. 21.
Figure 21:
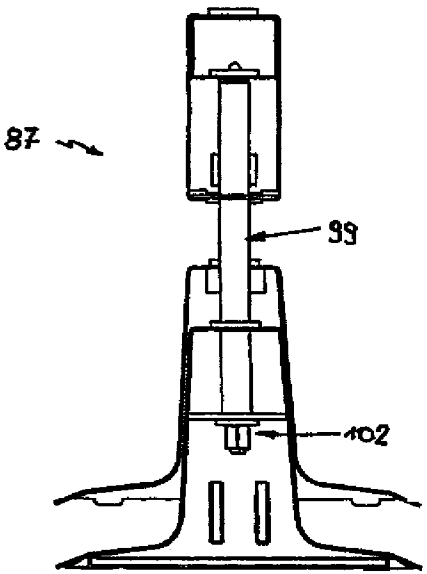
FIG. 21 shows a frontal view of the vehicle restraint system illustrated in FIG. 17 during connection of two guide barriers.
Figure 31:
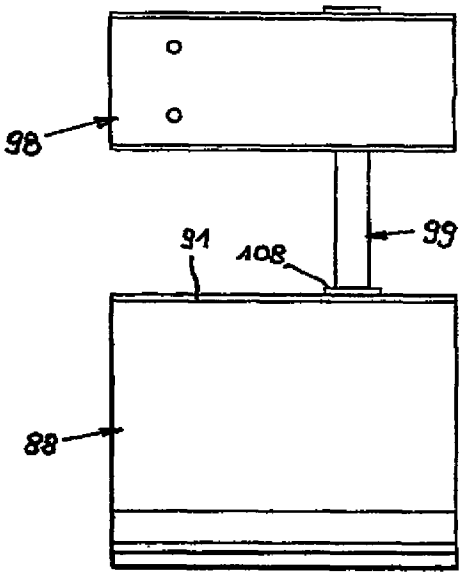
FIG. 31 shows a side view of the embodiment illustrated in FIG. 28.
Figure 29:
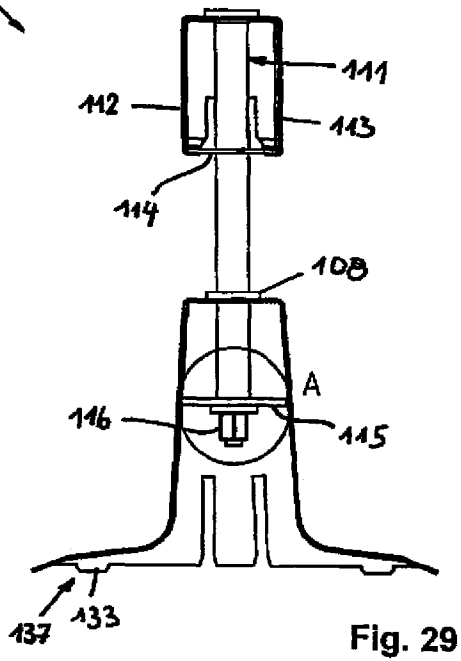
FIG. 29 shows a top view of the embodiment illustrated in FIG. 28.
Figure 30:
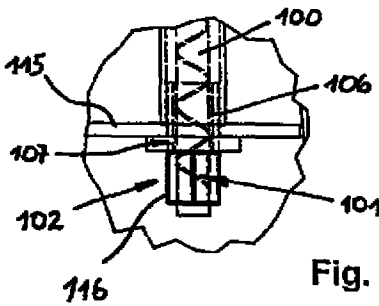
FIG. 30 shows the detail A of FIG. 29 on an enlarged scale.
Figure 28:
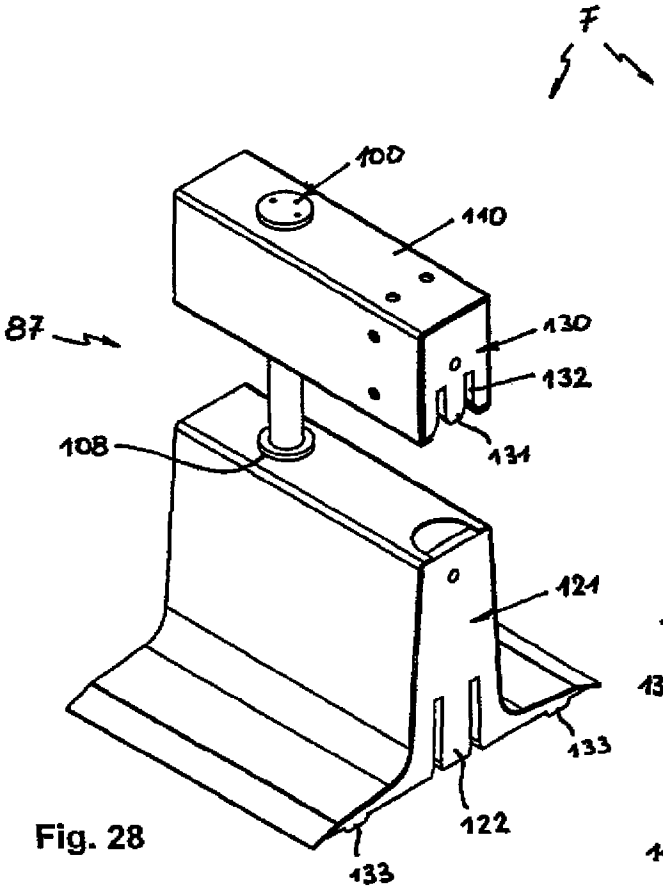
FIG. 28 shows in a perspective view the second end face of a guide barrier of a vehicle restraint system according to the invention.
Figure 35:
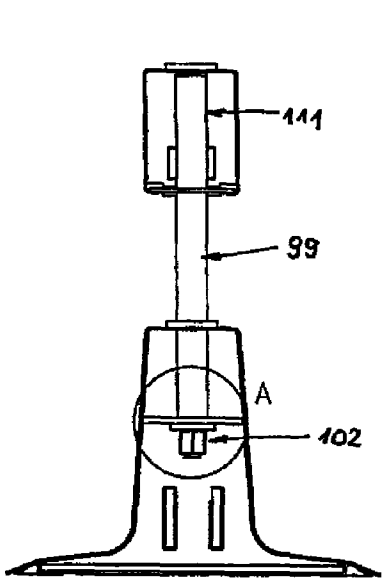
FIG. 35 shows a frontal view of the embodiment illustrated in FIG. 32, however without end wall and with a view into the interior of the base body and the guide rail.
Figure 34:
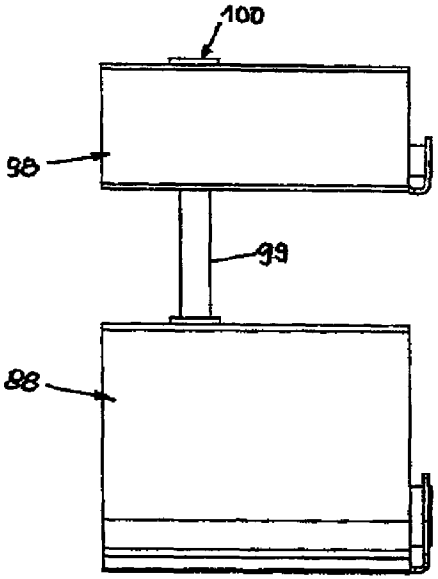
FIG. 34 shows a side view of the embodiment illustrated in FIG. 32.
Figure 33:
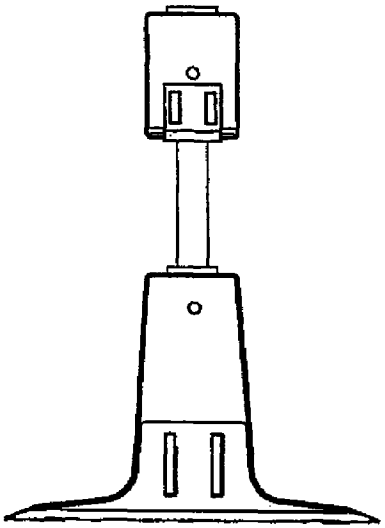
FIG. 33 shows a top view of the embodiment illustrated in FIG. 32.
Figure 36:
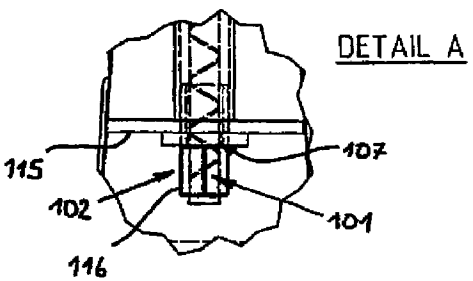
FIG. 36 shows the detail A of FIG. 35 on an enlarged scale.
Figure 32:
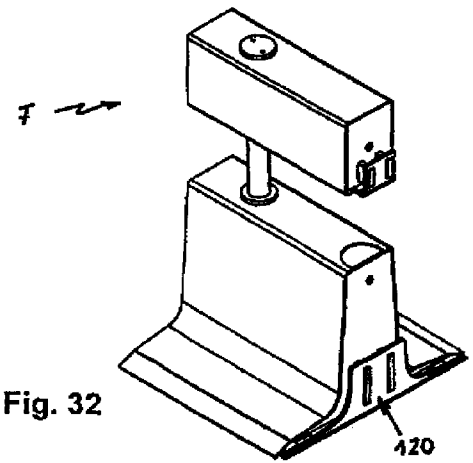
FIG. 32 shows in a perspective view the first end face of a guide barrier of a vehicle restraint system according to the invention.

FIGS. 16 and 17 show another embodiment of a vehicle restraint system E, representing a modification of the vehicle restraint system A. The basic components and parts of the component are therefore not described again.

The vehicle restraint system E includes friction-enhancing means 84 disposed on the ground-facing side of the base body 2. To this end, a spring plate 85 with a bottom friction cover 86 is arranged transversely between the marginal sections 12, 13 of the support plates 10, 11. The spring plate 85 can be pressed downwardly with the threaded rod 19, as indicated by arrow P in FIG. 16. The pressing force of the friction-enhancing means 84 against the ground is adjusted with the threaded rod 19. FIG. 17 shows the spring plate 85 and the friction cover 86 in a state pressed against the ground. This increases the resistance of the vehicle restraint system E against transverse displacement.

FIGS. 18 to 36 describe another embodiment of a vehicle restraint system F according to the invention. The vehicle restraint system F also consists of guide barriers 87 detachably placed side-by-side. Each guide barrier 87 has a housing-type base body 88 that can be placed on the ground with roof-shaped inclined lateral impact plates 89, 90 which are connected by an upper cover plate 91. Outwardly oriented support plates 94, 95 extend from the base body 88 from the lower longitudinal edges 92, 93 of the impact plates 89, 90. The marginal sections 96, 97 of the support plates 94, 95 are bent slightly downwardly.

A guide rail 98 with C-shape profile which is open towards the bottom extends above the base body 88 of a guide rail 87 with a spacing therebetween.

The guide rails 98 and the base bodies 88 are vertically spaced from one another by tubular spacers 99 and releasably connected with one another by tension rods implemented as threaded rods 100. The threaded rods 100 extend in the longitudinal direction through the spacers 99 and can be tensioned with their lower end 101 (see FIGS. 30 and 36) in an abutment 102 arranged inside the base body 88. Openings 103 are provided in the cover plate 91 of the base body 88, through which the lower longitudinal section 104 of the spacers 99 is inserted in the base body 88. The spacers 99 extend to the abutment 102 where they are supported. A centering pin 106, which engages in a seat 107 in the region of the abutment 102, is provided on the lower end 105 of the spacer 99. The spacers contact a crown-shaped limit stop 108 above the cover plate 91.

The threaded rods 100 have an external thread implemented as a coarse thread and pass with their upper end 109 through the guide rail 98. The guide rails 98 rest with their horizontal legs 110 on the upper end 111 of the spacer 99. The lateral legs 112, 113 of a guide rail 98 are connected in the region of a spacer 99 by a stiffening plate 114, through which the spacer 99 passes.

The abutment 102 is formed by an abutment plate 115 arranged in the base body 88 and secured transversely between the impact plate 89, 90, and a threaded nut 116 arranged below the abutment plate 115.

The guide barriers 87 of the vehicle restraint system F are coupled by way of plug connections 117, 118 between the base bodies 88 abutting in the longitudinal direction and the guide rails 98 which also abut in the longitudinal direction. Each base body 88 has on a first end face 119 an insertion pocket 120 and on the other second end face 121 an insertion tap 122. The insertion pocket 120 is formed by a front-side butt plate 123, which is spaced from the first end face 119 by two vertical ribs 124. The insertion tab 122 is formed in the first end face 121 between two vertical slots 125. The two base bodies 88 are connected by inserting the insertion tab 122 of one base body 88 in the insertion pocket 120 of the adjacent based body 88. The vertical slots 125 then encompass the vertical ribs 124, establishing the plug connection.

Two guide rails 98 are coupled in a similar manner. An insertion pocket 127 which is formed of a butt plate 128 bent away from the end face and spaced from the first end face 126 by two vertical ribs 129, is provided on a first end face 126 of a guide rail 98. An insertion tab 131 is formed on the second end face 130 of a guide rail 88 between two vertical slots 132. When two guide barriers 87 are connected, the insertion tabs 131 formfittingly engage with the insertion pockets 127.

The cover plates 91 of two abutting base bodies are connected with one another, like in the aforedescribed embodiments, by a plug plate 47 which overlaps the butt joint 46 and is inserted in receptacles 48 in the joint region of the cover plates 91. Reference is made here to the description of the vehicle restraint system A.

To increase the stability of the connection between two guide barriers 87 or two base bodies 88, respectively, these are interlocked in the connection region. To this end, pin-shaped projections 133 are provided at the bottom of the second end face 121 of the base body 88. Corresponding recesses 135 are provided in the bottom web 134 of the insertion pocket 120. When two base bodies 88 are coupled to one another, the projections 133 engage with the recesses 135, thereby establishing an interlock. The projections 133 and the recesses 135 are each arranged in the outer marginal regions 136, 137 of the insertion pocket 120 and the second end face 121, below the support plates 94, 95 and adjacent to the marginal sections 96, 97. The base bodies 88 are connected with one another via the insertion pockets 120 and the insertion tabs 122, and via the interlocking arrangement of the projections 133 and the recesses 135. This arrangement ensures stable coupling of the two base bodies 88 to one another, so that they are able to withstand high bending moments and transverse forces.

Figure 37:
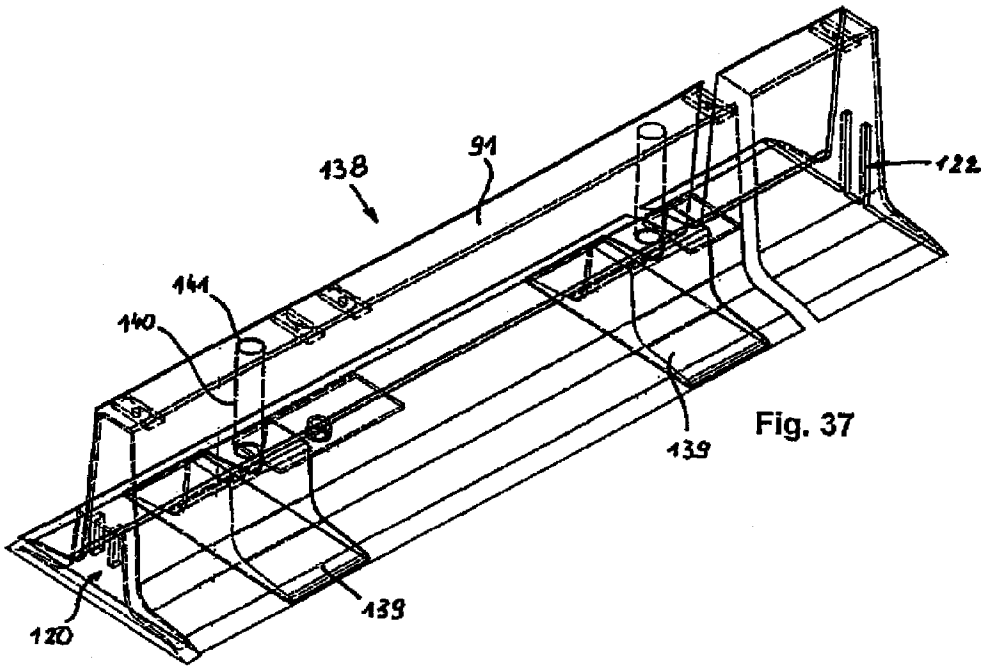
FIG. 37 is a perspective view of the base body of another embodiment of a vehicle restraint system according to the invention.
Figure 39:
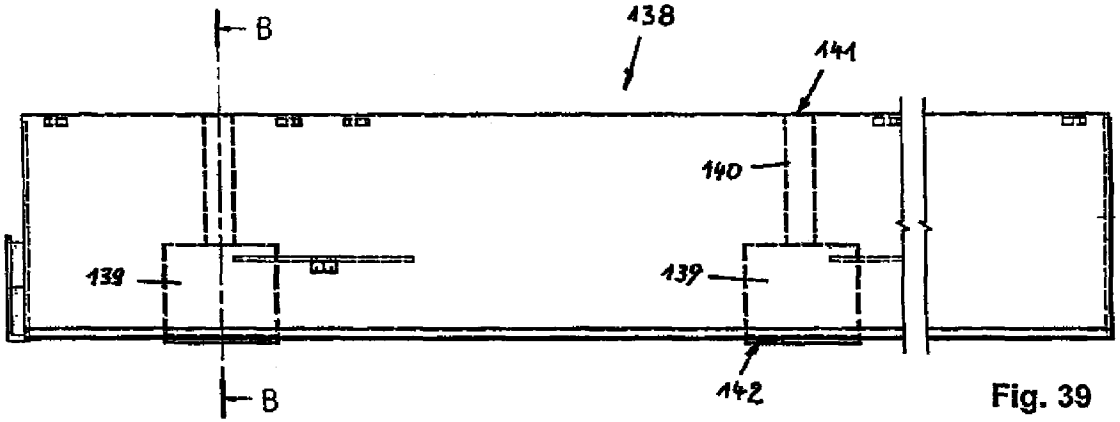
FIG. 39 shows a side view of the embodiment illustrated in FIG. 37.
Figure 38:
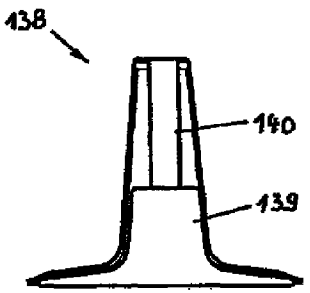
FIG. 38 shows a vertical section through the embodiment illustrated in FIG. 38 taken along the line B-B.

FIGS. 37 to 39 show a base body 138 of a vehicle restraint system according to the invention. To increase the steadiness and resistance against transverse displacement in the event of an impact, the base body 138 can be weighted down. To this end, fillable containers 139 are arranged in the base body 138. The containers 139 have a filler neck 140 which is accessible via an opening 141 in the cover plate 91. Friction-enhancing means 142 are provided on the bottom side of the container 139. Different materials can be used as weights, for example water, sand or other flowable and pourable materials.

In all other aspects, the basic construction of the base body 138 corresponds to the aforedescribed embodiments, which obviates the need for a separate description.

Figure 40:
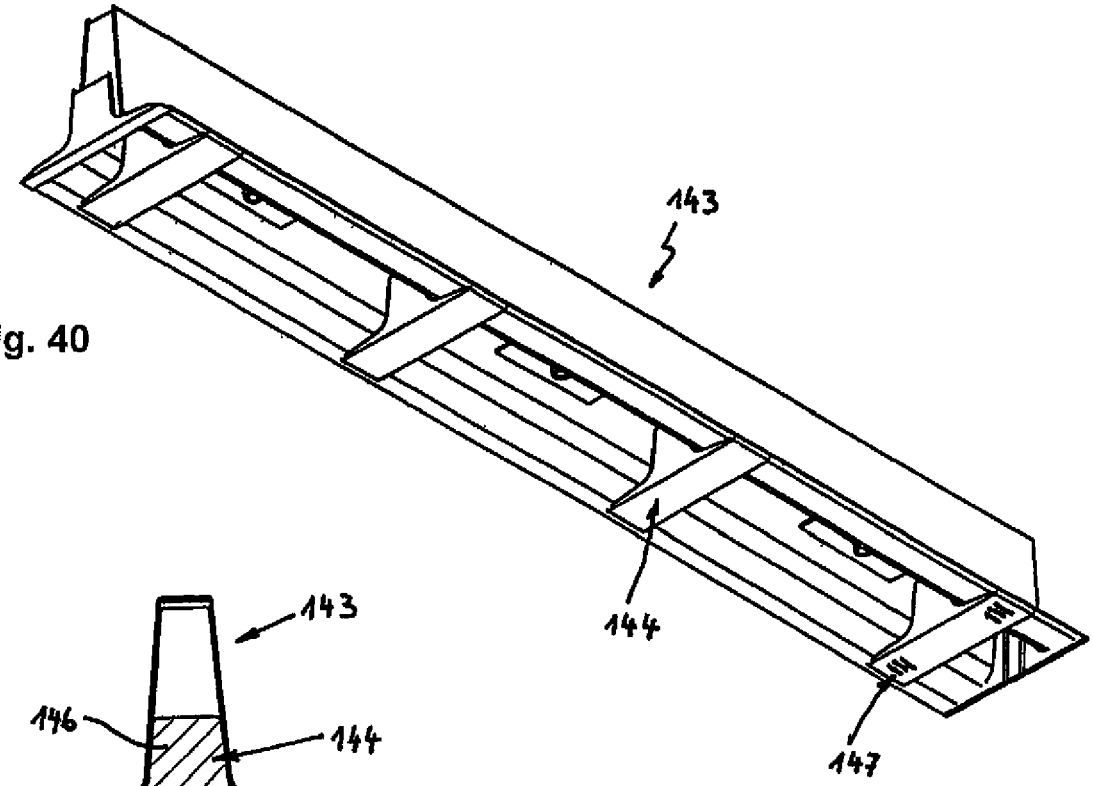
FIG. 40 is a perspective view of the base body of another embodiment of a vehicle restraint system according to the invention, as viewed at an angle from below.
Figure 41:
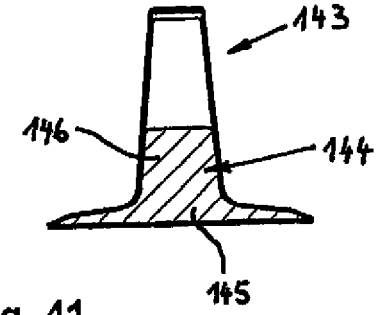
FIG. 41 is a vertical section through the base body illustrated in FIG. 40.

As illustrated in FIGS. 40 and 41, solid weighting bodies 144 are provided with the base body 143. These match the inner contour of the base body 143 and have a wide foot region 145 and an upper section 146 which extends between the impact plates 89, 90 and fills somewhat less than half the volume of the based body 143. The bottom side of the weighting bodies 144 is provided with friction-enhancing means 147.

Figure 42:
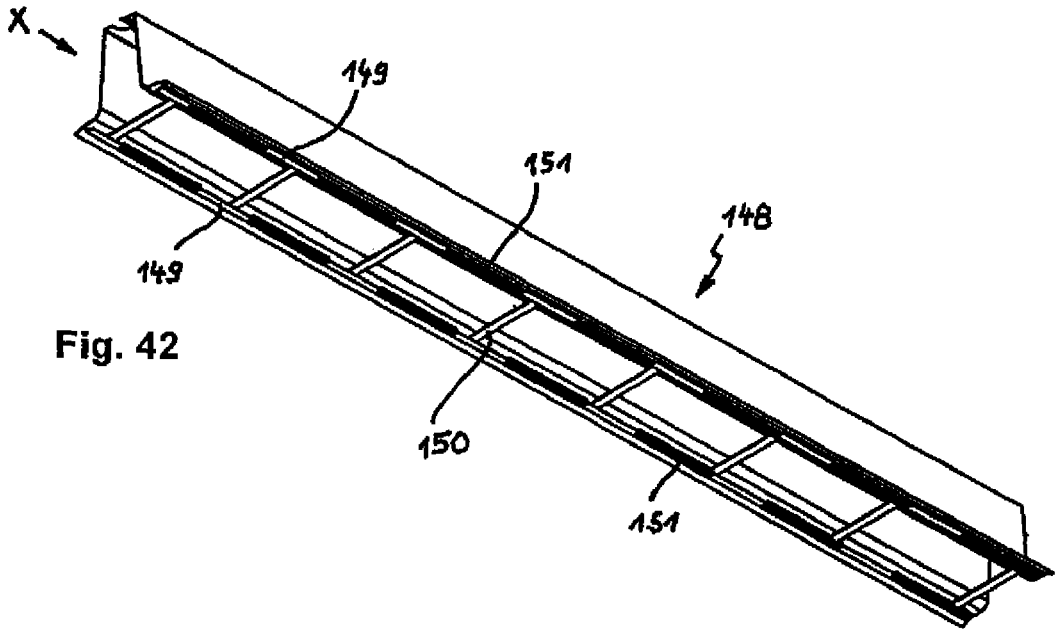
FIG. 42 is again a perspective view of the base body of another embodiment of a vehicle restraint system according to the invention, as viewed at an angle from below.
Figure 43:
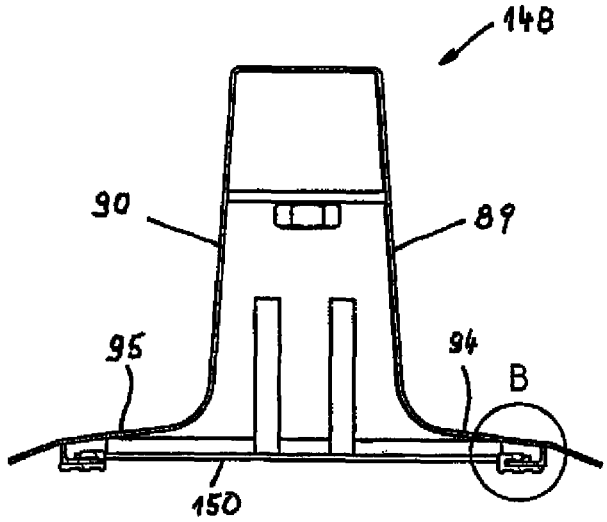
FIG. 43 is a frontal view on the base body according to FIG. 42 as viewed along the arrow X.
Figure 44:
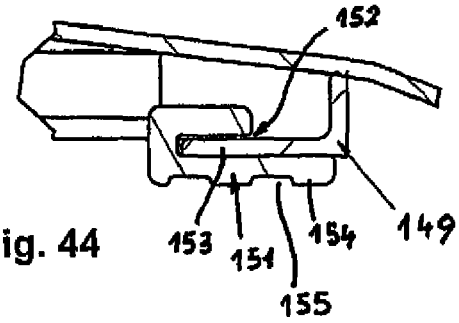
FIG. 44 shows the detail B of FIG. 43 on an enlarged scale.

FIGS. 42 to 44 illustrate another modification of a base body 148. The base body 148 includes support plates 94, 95 oriented outwardly from the impact plates 89, 90. Continuous angle rails 149, which extend in the longitudinal direction of the base body 148 and are connected by cross rails 150, are arranged below the support plates 94, 95. Several profile bodies 151 which are mutually spaced in the longitudinal direction and made of plastic or rubber are attached on the angle rails 149. The profile bodies 151 have a longitudinal slot 152 encompassing the free longitudinal leg 153 of the angle rails 149. The bottom side of the profile bodies 151 is structured with ribs 154 and longitudinal channels 155 disposed therebetween. The profile body 151 increases the friction coefficient between the bottom side of the base body 148 and the ground, thereby providing increased protection of the vehicle restraint system and of the guide barriers, respectively, against transverse displacement.

What is claimed is:

1. A vehicle restraint system for delimiting roadways, comprising guide barriers detachably placed side-by-side, each guide barrier comprising:

a base body adapted for placement on a ground, said base body comprising inclined roof-shaped lateral impact plates and an abutment plate secured in a lower third of the base body with a threaded portion or a threaded part, a guide rail which has a C-shaped cross-section defining opposing sidewalls and a top horizontal leg connecting the sidewalls, with the C-shaped guide rail being open towards a bottom and arranged above the base body, tension rods having a threaded portion and a length continuously spanning a distance from the top horizontal leg of the C-shaped guide rail to the threaded portion or part of the abutment plate to couple the guide rail and the base body, with an upper end of each tension rod connected to the top horizontal leg of the guide rail and a lower end threadable into the abutment plate, a top cover plate connecting the impact plates to one another, said cover plate having coupling locations for passage of the tension rods, and a support provided in the region of each of the coupling locations below the cover plate for guiding the tension rod.

2. The vehicle restraint system of claim 1, further comprising spacers to maintain the guide rail and the base body in vertical spaced-apart relationship, with the tension rods extending through the spacers.

3. The vehicle restraint system of claim 2, wherein the spacers have each a bottom support surface to support the spacers in seats at the coupling locations.

4. The vehicle restraint system of claim 1, wherein two of said guide rail are provided arranged on top of one another.

5. The vehicle restraint system of claim 1, wherein the guide rail has profiled sidewalls.

6. The vehicle restraint system of claim 1, further comprising guard planks mounted to the guide rail and extending in a longitudinal direction of the guide rail.

7. The vehicle restraint system of claim 1, wherein the base body is constructed for installation on rails which are fixed to the ground.

8. The vehicle restraint system of claim 1, further comprising a plug connection to couple two of said base bodies which abut one another in a longitudinal direction.

9. The vehicle restraint system of claim 1, wherein the base body has a first end face provided with an insertion pocket and a second end face provided with an insertion tab, wherein the insertion tab of the base body engages the insertion pocket of an adjacent said base body.

10. The vehicle restraint system of claim 9, wherein insertion pocket is formed by a front butt plate which is spaced from the first end face by two vertical ribs.

11. The vehicle restraint system of claim 9, wherein the insertion tab is formed between two vertical slots in the second end face.

12. The vehicle restraint system of claim 9, wherein the second end face of the base body has ground-proximal pin-shaped projections, said insertion pocket having a bottom rib provided with recesses for engagement of the projections, when the adjacent base bodies are coupled to one another.

13. The vehicle restraint system of claim 12, wherein the projections and the recesses are arranged in outer marginal regions of the second end face and the insertion pocket, respectively.

14. The vehicle restraint system of claim 1, further comprising a plug plate which interconnects cover plates of two adjacent base bodies abutting one another at a butt joint and which overlaps the butt joint.

15. The vehicle restraint system of claim 14, wherein the plug plate has a plate body with two transverse ribs projecting from the plug plate at a right angle.

16. The vehicle restraint system of claim 1, wherein two of said guide rail abut one another in a longitudinal direction, and further comprising a plug connection coupling the abutting guide rails.

17. The vehicle restraint system of claim 16, wherein the plug connection includes an angle profile provided on an end face of one of the guide rails and a coupling web disposed on an adjacent end face of the other one of the guide rails.

18. The vehicle restraint system of claim 1, further comprising at least one weighting body arranged in the base body.

19. The vehicle restraint system of claim 1, wherein the weighting body is provided with a friction-enhancing means on a side facing the ground.

20. The vehicle restraint system of claim 18, wherein the weighting body is formed by a tillable container.

21. The vehicle restraint system of claim 20, wherein the container has a filler neck which is accessible through an opening in the cover plate.

22. The vehicle restraint system of claim 20, wherein the container has a bottom side provided with a friction-enhancing means.

23. A vehicle restraint system for delimiting roadways, comprising guide barriers detachably placed side-by-side, each guide barrier comprising:

a base body adapted for placement on a ground, a guide rail arranged above the base body, tension rods to couple the guide rail and the base body, each tension rod having an upper end connected to the guide rail and a lower end braceable to an abutment arranged inside the base body, wherein the base body comprises inclined roof-shaped lateral impact plates, support plates oriented outwardly from the impact plates on the base body, angle rails extending in a longitudinal direction of the base body below the support plates, and profile bodies made of plastic or rubber and attached on the angle rails in longitudinally spaced-apart relationship, a top cover plate connecting the impact plates to one another, said cover plate having coupling locations for passage of the tension rods, and a support provided in the region of each of the coupling locations below the cover plate for guiding the tension rod.

24. The vehicle restraint system of claim 23, wherein the profile bodies have a longitudinal slot to encompass a free leg of the angle rail.

25. A vehicle restraint system for delimiting roadways, comprising guide barriers detachably placed side-by-side, each guide barrier comprising:

a base body adapted for placement placed on a ground and having a first end face provided with an insertion pocket and a second end face provided with an insertion tab, wherein the insertion tab of the base body engages the insertion pocket of an adjacent said base body, a guide rail arranged above the base body, tension rods to couple the guide rail and the base body, each tension rod having a bottom end braceable in an abutment inside the base body, and tubular spacers to maintain the guide rail and the base body in vertical spaced-apart relationship, wherein the tension rods extend through the spacers, wherein the second end face of the base body has ground-proximal pin-shaped projections, said insertion pocket having a bottom rib provided with recesses for engagement of the projections, when the adjacent base bodies are coupled to one another.

26. The vehicle restraint system of claim 25, further comprising a cover plate placed atop of the base body, each said spacer being guided through an opening of the cover plate for introduction into the base body and sized to extend to the abutment.

27. The vehicle restraint system of claim 26, wherein each said spacer is provided with a limit stop for contacting the cover plate.

28. The vehicle restraint system of claim 25, further comprising a centering pin is provided at a lower end of each said spacer to engage a seat in a region of the abutment.

29. The vehicle restraint system of claim 25, wherein each said tension rod is a threaded rod.

30. The vehicle restraint system of claim 25, wherein two of said guide rail are provided arranged on top of one another.

31. The vehicle restraint system of claim 25, wherein the guide rail has profiled sidewalls.

32. The vehicle restraint system of claim 25, further comprising guard planks mounted to the guide rail and extending in a longitudinal direction of the guide rail.

33. The vehicle restraint system of claim 25, further comprising friction-increasing means provided on a side of the base body facing the ground.

34. The vehicle restraint system of claim 33, wherein the friction-increasing means is connected at least indirectly with the tension rod and exerts against the ground a pressing force which is adjustable via the tension rod.

35. The vehicle restraint system of claim 25, wherein the base body is constructed for installation on rails which are fixed to the ground.

36. The vehicle restraint system of claim 25, further comprising a plug connection to couple two of said base bodies which abut one another in a longitudinal direction.

37. The vehicle restraint system of claim 25, wherein insertion pocket is formed by a front butt plate which is spaced from the first end face by two vertical ribs.

38. The vehicle restraint system of claim 25, wherein the insertion tab is formed between two vertical slots in the second end face.

39. The vehicle restraint system of claim 25, wherein the projections and the recesses are arranged in outer marginal regions of the second end face and the insertion pocket, respectively.

40. The vehicle restraint system of claim 26, further comprising a plug plate which interconnects cover plates of two adjacent base bodies abutting one another at a butt joint and which overlaps the butt joint.

41. The vehicle restraint system of claim 40, wherein the plug plate has a plate body with two transverse ribs projecting from the plug plate at a right angle.

42. The vehicle restraint system of claim 25, wherein two of said guide rail abut one another in a longitudinal direction, and further comprising a plug connection coupling the abutting guide rails.

43. The vehicle restraint system of claim 42, wherein the plug connection includes an angle profile provided on an end face of one of the guide rails and a coupling web disposed on an adjacent end face of the other one of the guide rails.

44. The vehicle restraint system of claim 25, further comprising at least one weighting body arranged in the base body.

45. The vehicle restraint system of claim 44, wherein the weighting body is provided with a friction-enhancing means on a side facing the ground.

46. The vehicle restraint system of claim 44, wherein the weighting body is formed by a fillable container.

47. The vehicle restraint system of claim 46, wherein the container has a filler neck which is accessible through an opening in the cover plate.

48. The vehicle restraint system of claim 46, wherein the container has a bottom side provided with a friction-enhancing means.

49. A vehicle restraint system for delimiting roadways, comprising guide barriers detachably placed side-by-side, each guide barrier comprising:

a base body adapted for placement placed on a ground, a guide rail arranged above the base body, tension rods to couple the guide rail and the base body, each tension rod having a bottom end braceable in an abutment inside the base body, tubular spacers to maintain the guide rail and the base body in vertical spaced-apart relationship, wherein the tension rods extend through the spacers, and support plates oriented outwardly from the impact plates on the base body, angle rails extending in a longitudinal direction of the base body below the support plates, and profile bodies made of plastic or rubber and attached on the angle rails in longitudinally spaced-apart relationship.

50. The vehicle restraint system of claim 49, wherein the profile bodies have a longitudinal slot to encompass a free leg of the angle rail.

* * * * *

UNITED STATES PATENT AND TRADEMARK OFFICE

CERTIFICATE OF CORRECTION

PATENT NO. : 7,950,871 B2
APPLICATION NO. : 12/444282
DATED : May 31, 2011
INVENTOR(S) : Horst Lass et al.

It is certified that error appears in the above-identified patent and that said Letters Patent is hereby corrected as shown below:

Column 2, delete lines 26-29.
Column 2, before line 30 add -- In an advantageous embodiment, the guide rail is mounted with a vertical spacing on the base body by way of spacers, wherein all tension rods extend through the spacers. In particular, the spacers can be constructed in tubular form. A spacer in form of a tube with a rounded outer periphery advantageously has no sharp edges along its periphery. This is advantageous in particular for vehicle restraint systems for median strips, where collisions can occur from both directions.

The spacers have bottom support surfaces providing support in seats disposed at the coupling locations. --

Column 12, line 36, change “tillable” to -- fillable --.

Signed and Sealed this
Sixteenth Day of August, 2011

David J. Kappos

David J. Kappos
*Director of the United States Patent and Trademark Office*